US006955555B2

(12) United States Patent
Ohtani et al.

(10) Patent No.: US 6,955,555 B2
(45) Date of Patent: Oct. 18, 2005

(54) CONNECTOR WITH CONTROL MECHANISM OF ENGAGEMENT WITH MATING CONNECTOR

(75) Inventors: Hideyuki Ohtani, Hachioji (JP); Yosuke Saito, Oume (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 11/067,446

(22) Filed: Feb. 25, 2005

(65) Prior Publication Data

US 2005/0142924 A1 Jun. 30, 2005

Related U.S. Application Data

(62) Division of application No. 10/376,780, filed on Feb. 27, 2003, now Pat. No. 6,860,748.

(30) Foreign Application Priority Data

Feb. 28, 2002 (JP) ..... 2002-52887

(51) Int. Cl.[7] ..... H01R 13/627
(52) U.S. Cl. ..... 439/352
(58) Field of Search ..... 439/350–358, 439/587, 595, 752

(56) References Cited

U.S. PATENT DOCUMENTS

| | | | |
|---|---|---|---|
| 4,838,808 A | 6/1989 | Fujiura | |
| 5,529,512 A | 6/1996 | Mlyniec | |
| 5,634,809 A | 6/1997 | Hirai | |
| 5,954,531 A | 9/1999 | Jennings et al. | |
| 5,997,323 A | 12/1999 | Youn | |
| 6,116,937 A | 9/2000 | Pan | |
| 6,132,231 A | 10/2000 | Suzuki | |
| 6,319,040 B1 | 11/2001 | Chang | |
| 6,346,002 B1 | 2/2002 | Hsu et al. | |
| 6,457,987 B1 | 10/2002 | Yeh | |
| 6,659,790 B1 | 12/2003 | Wu | |
| 6,702,603 B2 | 3/2004 | Wu | |
| 6,865,369 B2 * | 3/2005 | Semmeling et al. | 434/357 |

FOREIGN PATENT DOCUMENTS

| | | |
|---|---|---|
| JP | 09-063694 | 3/1997 |
| JP | 10-302893 | 11/1998 |
| JP | 2001-217038 | 8/2001 |

* cited by examiner

*Primary Examiner*—Gary Paumen
(74) *Attorney, Agent, or Firm*—Michael Best & Friedrich LLP

(57) ABSTRACT

A connector (1) comprises two lock springs (6) provided with locking claws (6E), respectively, and a control mechanism (7, 8) for controlling positions of the locking claws (6E). The lock springs (6) are arranged parallel to each other in an X-direction. The locking claws (6E) are arranged parallel to each other in the X-direction. The control mechanism comprises a single button (7) and a cam mechanism (8), which is coupled to the single button (7) and has two cam portions (8B) arranged close to the lock springs (6) in the X-direction. When the single button (7) is operated, the cam portions (8B) add forces to the lock springs (6) simultaneously to elastically deform the lock springs (6) so that the locking claws (6E) are retracted inside a shell (4).

5 Claims, 25 Drawing Sheets

CONNECTOR WITH CONTROL MECHANISM OF ENGAGEMENT WITH MATING CONNECTOR

This application is a divisional application of U.S. patent application Ser. No. 10/376,780, filed Feb. 27, 2003, now U.S. Pat. No. 6,860,748 which claims priority of Japanese Patent Application No. 52887/2002, filed Feb. 28, 2002.

BACKGROUND OF THE INVENTION

This invention relates to a connector with a control mechanism for controlling engagement with a mating connector.

In order to prevent undesired removal of a connector fitted with a mating connector, the connector normally has engagement portions which engage with other engagement portions of the mating connector after the connector is fitted with the mating connector. Typical engagement portions are locking projections such as locking claws or claws, while ones of a mating connector are slits or grooves with which the locking claws can engage.

Conventionally, a connector with locking projections comprises a control mechanism for controlling the above-mentioned engagement, especially, the positions of the locking projections. The conventional control mechanism includes two buttons provided on opposite sides of the connector in a lateral direction. When the buttons are pinched and are pushed inwardly by two fingers of a user, the locking projections do not work for a mating connector so that the engagement is released if it is established before or that the connector can be easily fitted with the mating connector when being connected to the mating connector. Such a connector is disclosed for example in JP-A 2001-217038.

SUMMARY OF THE INVENTION

It is an object of the present invention to improve the above-mentioned connector and to provide a connector having a control mechanism which includes a single button for controlling at least two projections such as locking claws.

According to this invention, there is provided a connector comprising at least two springs provided with locking projections, respectively, and a control mechanism which controls positions of the locking projections, the control mechanism comprising a single button and a cam mechanism, which is coupled to the single button and has two cam portions arranged close to the two springs so that, when the single button is operated, the two cam portions add forces corresponding to movement of the single button to the two springs simultaneously to elastically deform the two springs and thereby to control the positions of the locking projections.

DESCRIPTION OF PREFERRED EMBODIMENTS

Figure 1:
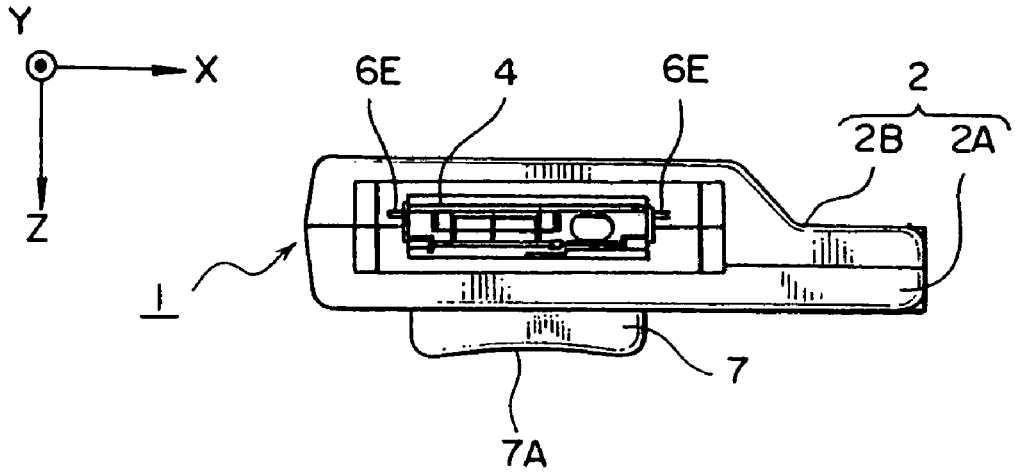
FIG. 1 is a front view showing a connector according to a first embodiment of the present invention.
Figure 2:
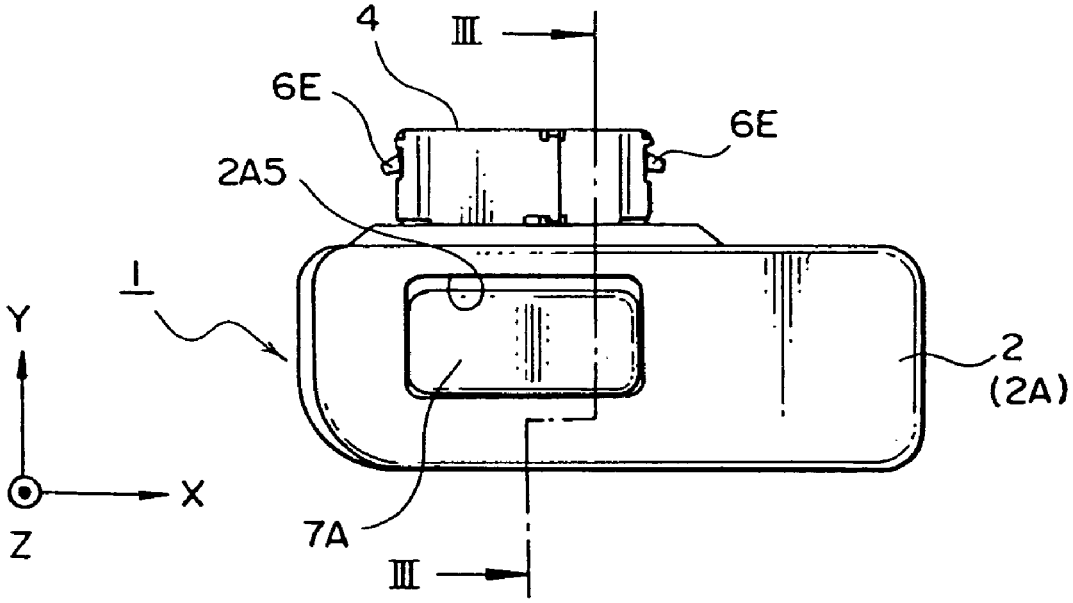
FIG. 2 is a top plan view of the connector illustrated in FIG. 1.

With reference to FIGS. 1 to 5, a connector 1 according to a first embodiment of the present invention comprises a plurality of contacts 5 extending in a Y-direction, an insulator 9 supporting the contacts 5, a shell 4 surrounding the contacts 5 and the insulator 9, and a casing 2 accommodating them so that they partially project outside the casing 2 in the Y-direction (e.g. see FIG. 2). One end of the shell 4 defines an interface for a mating connector and is fitted with the mating connector when the connector 1 and the mating connector are connected to each other. Each of the contacts 5 has a connection portion 5A at the rear end in the Y-direction. To the connection portion 5A, for example, a cable is connected. The contacts 5 are arranged parallel to each other as especially shown in FIGS. 4 and 5, but may be arranged in a plurality of rows of contacts.

Under the normal condition, two locking claws 6E project from the shell 4 outwardly in an X-direction perpendicular to the Y-direction, as especially seen from FIG. 2. The locking claws 6E engage with slits or grooves provided for the mating connector, after or at that time the connector 1 and the mating connector are fitted with each other. The positions of the locking claws 6E are controlled by a control mechanism including a single button 7 and are retracted within the shell 4 when the single button 7 is operated. The control mechanism of this embodiment is described in detail afterwards.

The casing 2 comprises an upper casing 2A and a lower casing 2B. The upper casing 2A is made of insulator material, such as synthetic resin, and is provided with two holes 2A1, 2A2, a partial screw hole 2A3, an upper cavity 2A4, an opening 2A5 and a slit 2A6. The holes 2A1, 2A2 and the partial screw hole 2A3 extend in a Z-direction perpendicular to the X- and the Y-directions, but do not penetrate the upper casing 2A. The opening 2A5 is formed on the upper surface of the upper casing 2A so as to communicate between the upper cavity 2A4 and the outside of the casing 2. The slit 2A6 is formed so as to extend in the X-direction.

The lower casing 2B is also made of insulator material, such as synthetic resin, and is provided with two bosses 2B1, 2B2, a partial screw hole 2B3, a lower cavity 2B4, and two accommodation pockets 2B5. The two bosses 2B1, 2B2 are pushed into the holes 2A1, 2A2, respectively, when the upper and lower casing 2A, 2B are fitted with each other to form the casing 2. The partial screw hole 2B3 of the lower casing 2B and the partial screw hole 2A3 of the upper casing 2A form a screw hole into which a screw 3 is inserted when the upper and lower casing 2A, 2B are combined with each other. The lower cavity 2B4 and the upper cavity 2A4 make one cavity which accommodates almost all parts of the connector 1 including the control mechanism for controlling the engagement of the locking claws 6E with the slits of the mating connector. The accommodation pockets 2B5 are formed on the lower parts of the lower cavity 2B4 to accommodate parts of the control mechanism. The accommodation is described later in connection with the structure and the operation of the control mechanism.

The control mechanism according to this embodiment comprises two lock spring 6, a button 7, and a button-support spring 8. In this embodiment, two parts of the button-support spring 8 serve as two cam portions which, when the button 7 is pushed down in the Z-direction, add lateral forces to the lock springs 6 simultaneously to elastically deform the lock springs 6 and, thereby, to retract the locking claws 6E provided for the lock springs 6.

Figure 5:
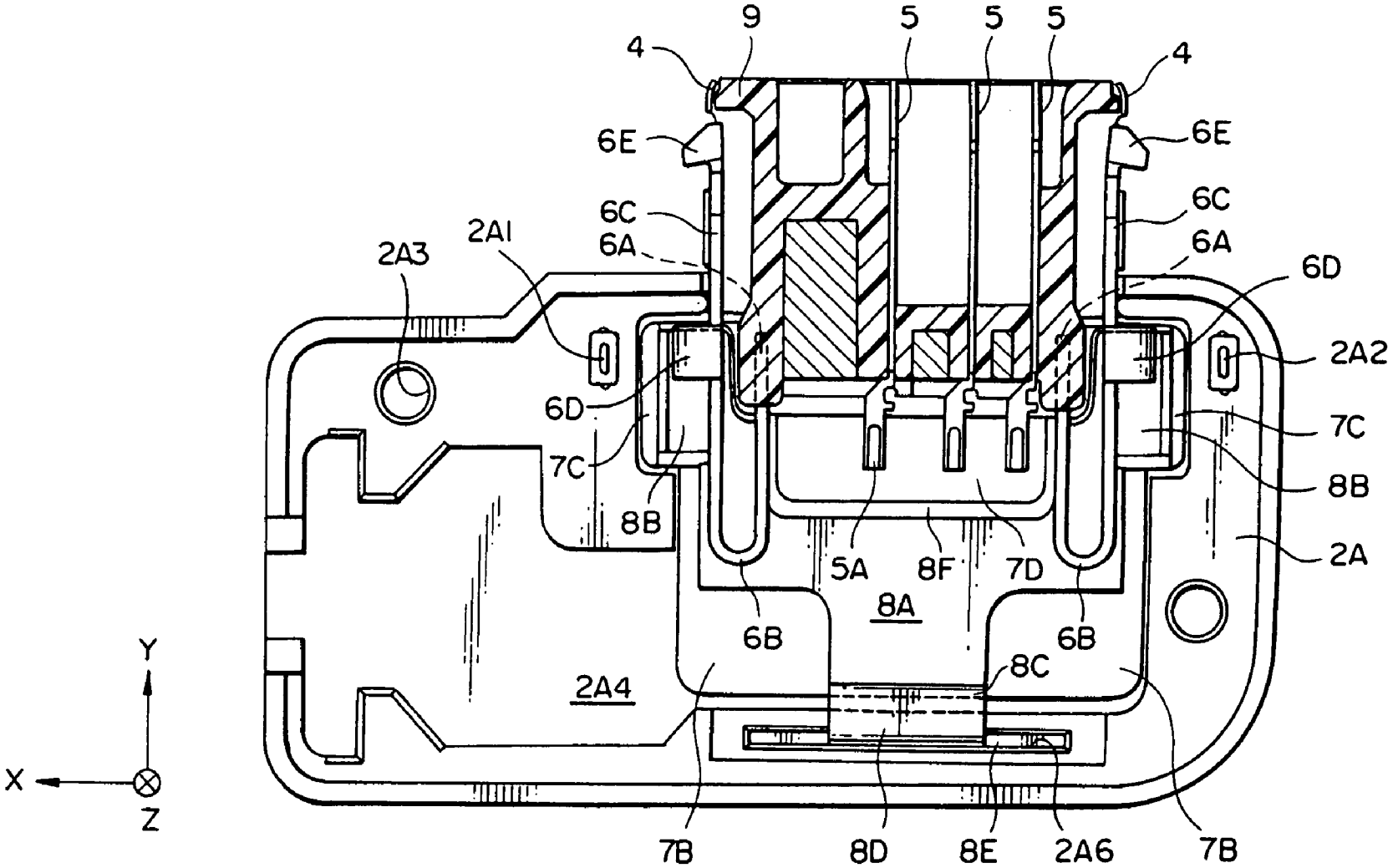
FIG. 5 is a cross-sectional view of the connector taken along lines V—V of FIG. 4.
Figure 6:
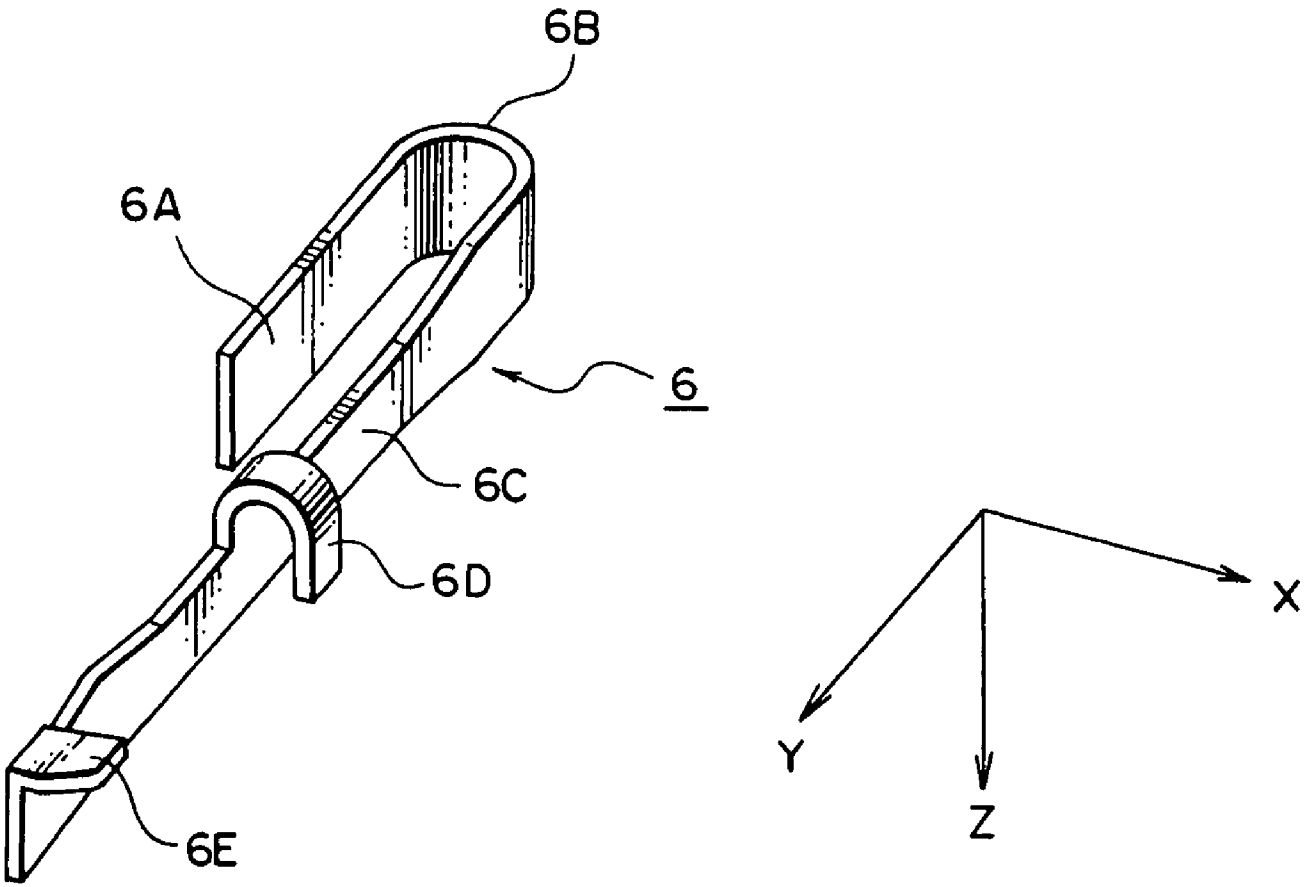
FIG. 6 is a perspective view showing a lock spring which is included in the connector of FIG. 1.

In detail, each of the lock springs 6 comprises a fixed portion 6A, a U-like portion 6B, an extending portion 6C and a curved projection 6D, in addition to the locking claw 6E, as shown in FIG. 6. The fixed portion 6A is put into and fixed into the insulator 9, as especially shown in FIG. 5. The U-like portion 6B continues from the fixed portion 6A. The extending portion 6C extends from the U-like portion 6B toward the interface defined by the shell 4, as shown in FIG. 5. On the tip of the extending portion 6C, the locking claw 6E is formed so as to project outwardly in the X-direction. The curved projection 6D projects from the middle of the extending portion 6C upwardly in the Z-direction and is curved outwardly in the X-direction so as to also project outwardly in the X-direction.

Figure 3:
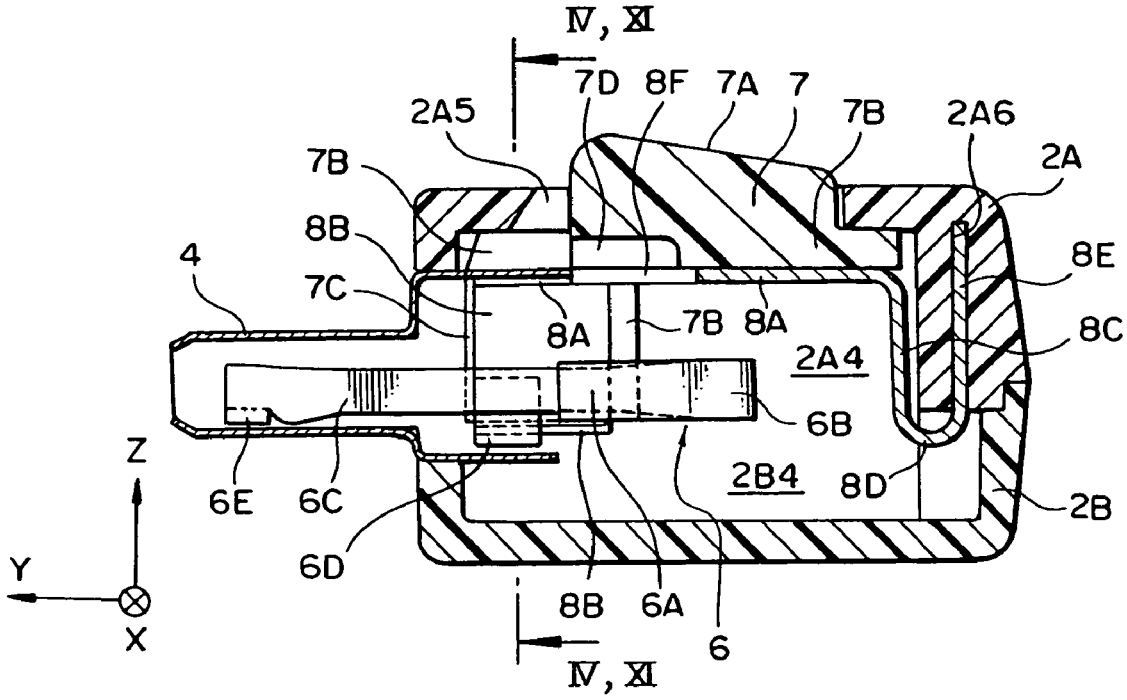
FIG. 3 is a cross-sectional view of the connector taken along lines III—III of FIG. 2, wherein some parts are omitted for the sake of better understanding.
Figure 4:
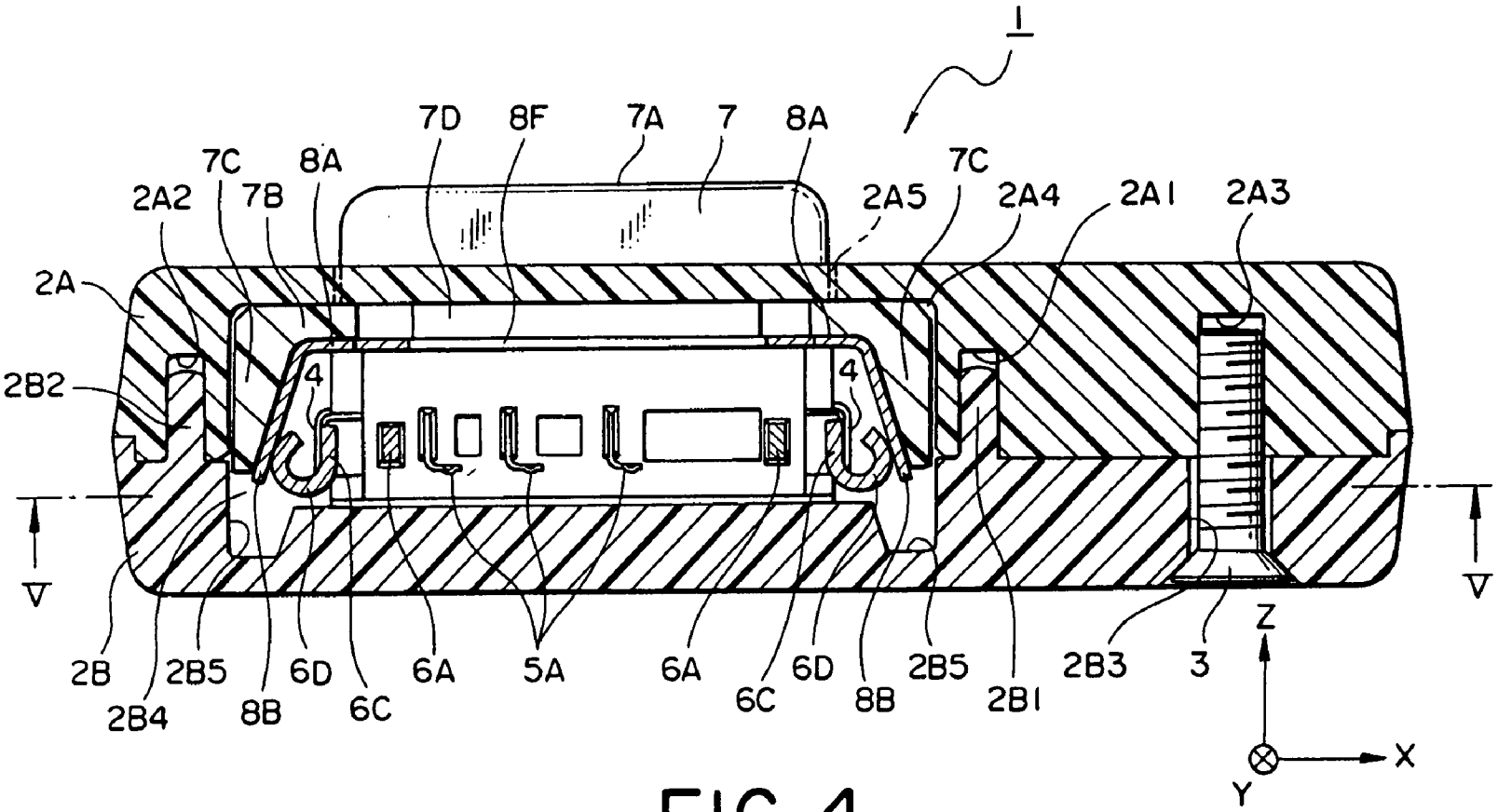
FIG. 4 is a cross-sectional view of the connector taken along lines IV—IV of FIG. 3.

The button 7 comprises a main part having an upper surface 7A which projects through the opening 2A5 of the upper casing 2 to the outside of the connector 1, as shown in FIGS. 3 and 4. The main part of the button 7 is formed on a base portion 7B which is an insulator plate having a Y-like shape, as shown in FIGS. 7 to 10. The base portion 7B having the Y-like shape defines a space 7D in order to prevent the undesired collision with the insulator 9 and so on when the button 7 is pushed down in the Z-direction. On the two ends of the Y-like shape of the base portion 7B, two arm portions 7C are provided. The arm portions 7C extend downwardly from opposite side edges at the ends of the base portion 7B. Each of the arm portions 7C tapers off downwardly in the Z-direction.

Figure 7:
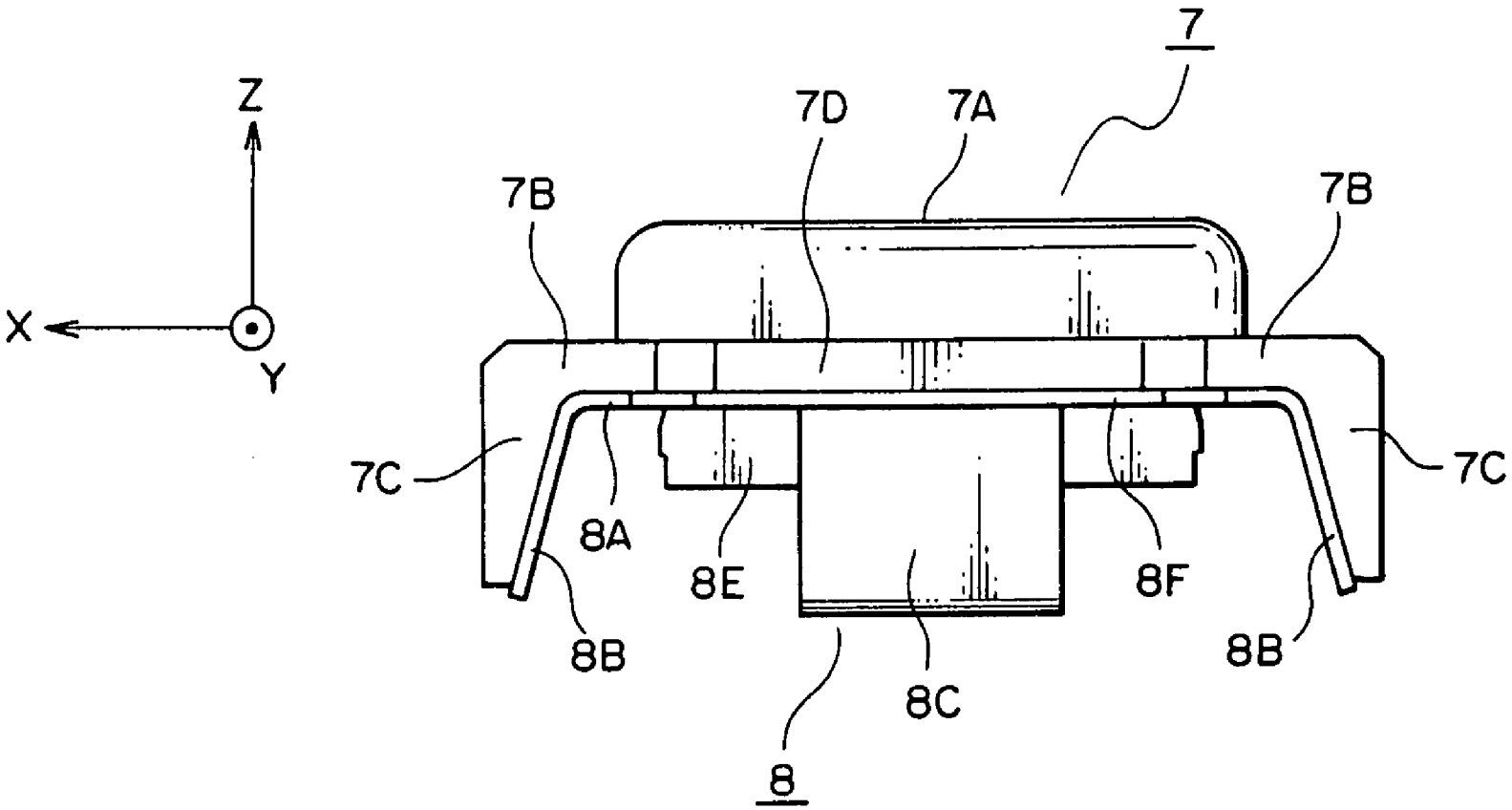
FIG. 7 is a front view of a button and a button-support spring which are included in the connector of FIG. 1.
Figure 8:
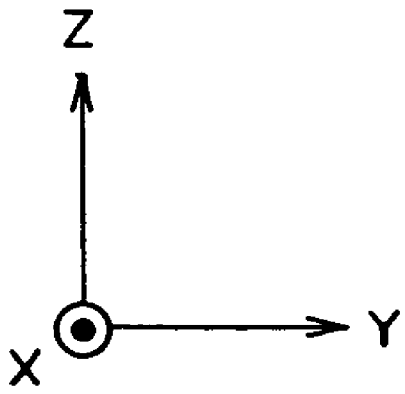
FIG. 8 is a side view of the button and the button-support spring illustrated in FIG. 7.
Figure 8:
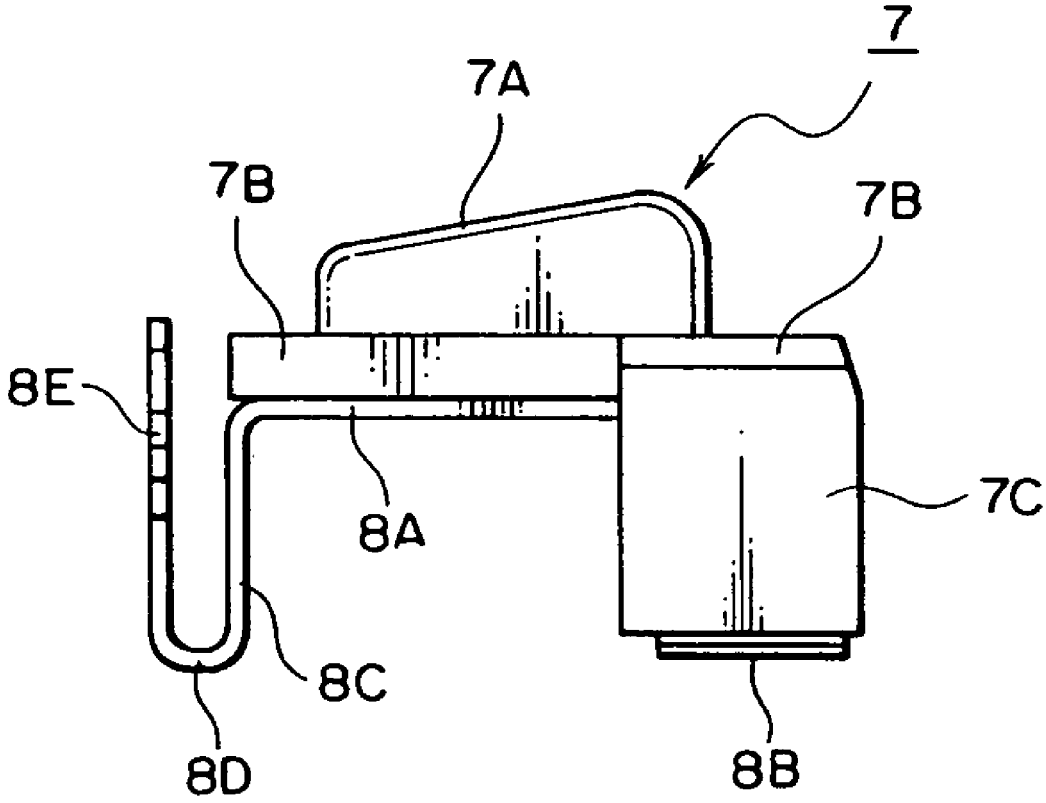
Figure 9:
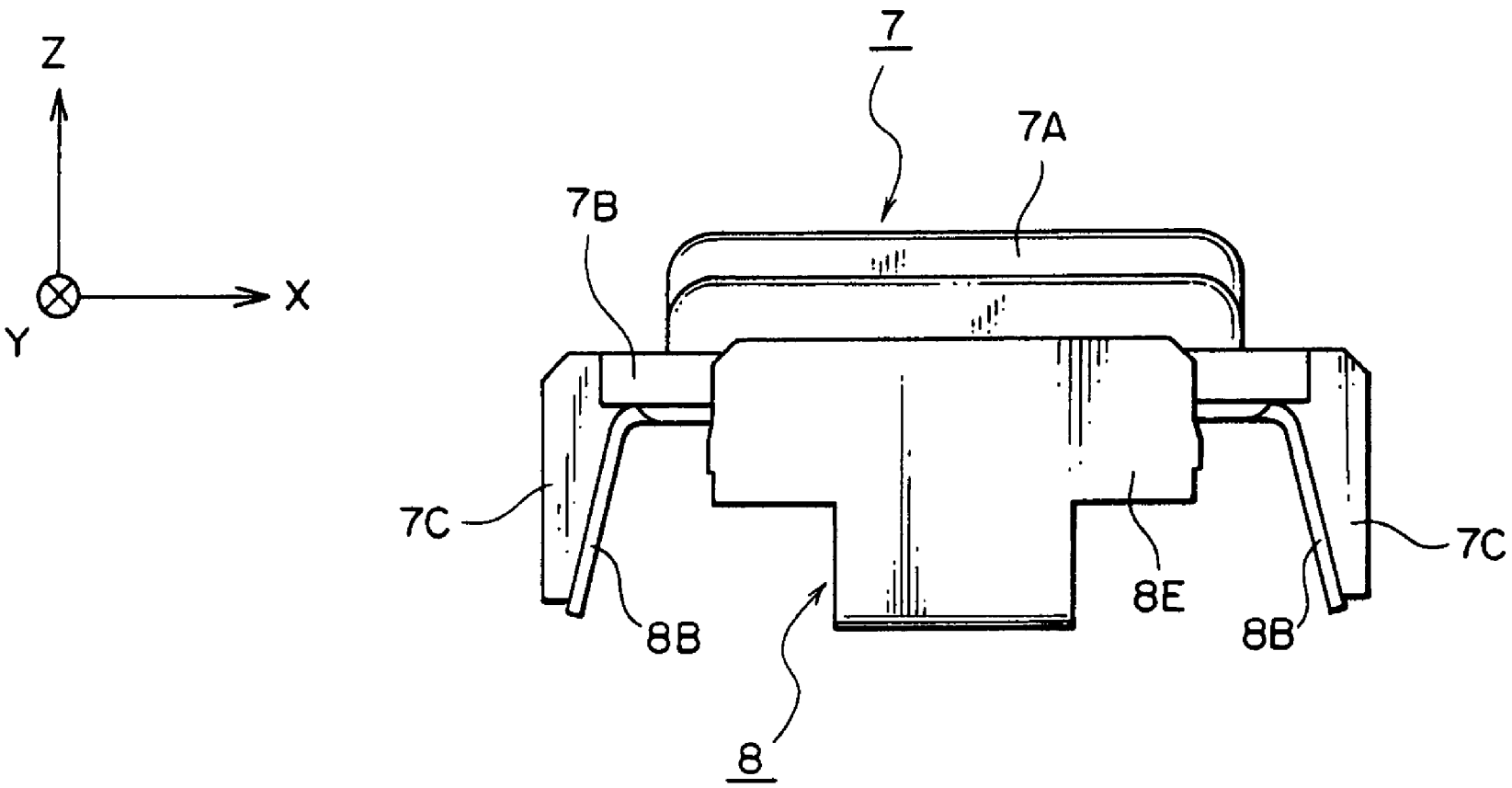
FIG. 9 is a rear view of the button and the button-support spring illustrated in FIG. 7.
Figure 10:
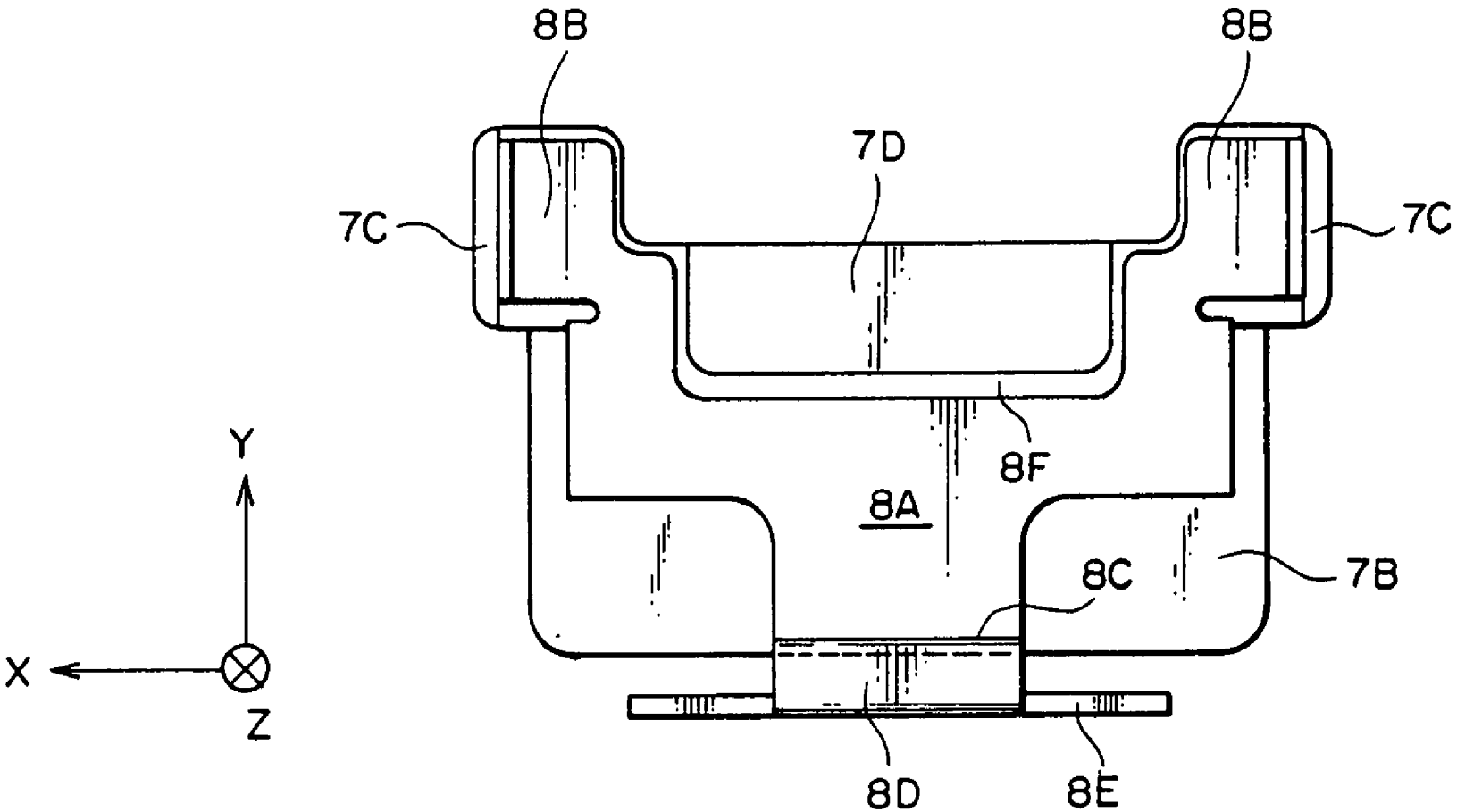
FIG. 10 is a bottom view of the button and the button-support spring illustrated in FIG. 7.

The button-support spring 8 is made of metal and comprises a main plate 8A, two slanting side portions 8B, a vertical portion 8C, a U-like portion 8D and a fixed portion 8E, as shown in FIGS. 7 to 10. The main plate 8A supports the button 7, especially, the base portion 7B of the button 7. The main plate 8A has the similar shape to the base portion 7B and defines a similar space 8F to prevent the undesired collision, as especially shown in FIG. 10. The slanting side portions 8B extend downwardly from the opposite side edges at the ends of the main plate 8A. The surfaces of the slanting side portions 8B are diagonally across the X- and the Z-directions, as shown in FIGS. 4, 7 and 9. The vertical portion 8C extends downwardly from the rear end of the main plate 8A in the Z-direction and continues to the U-like portion 8D. The fixed portion 8E continues and extends upwardly from the U-like portion 8D. The end of the fixed portion 8E is inserted into and fitted within the slit 2A6 of the upper casing 2A. The vertical portion 8C, the U-like portion 8D and the fixed portion 8E provide an elastic force for the support of the button 7. In other words, the button 7 is elastically supported by the button-support spring 8. This elastic support results in that the button is in the normal position thereof when the button 7 is not operated.

Figure 11:
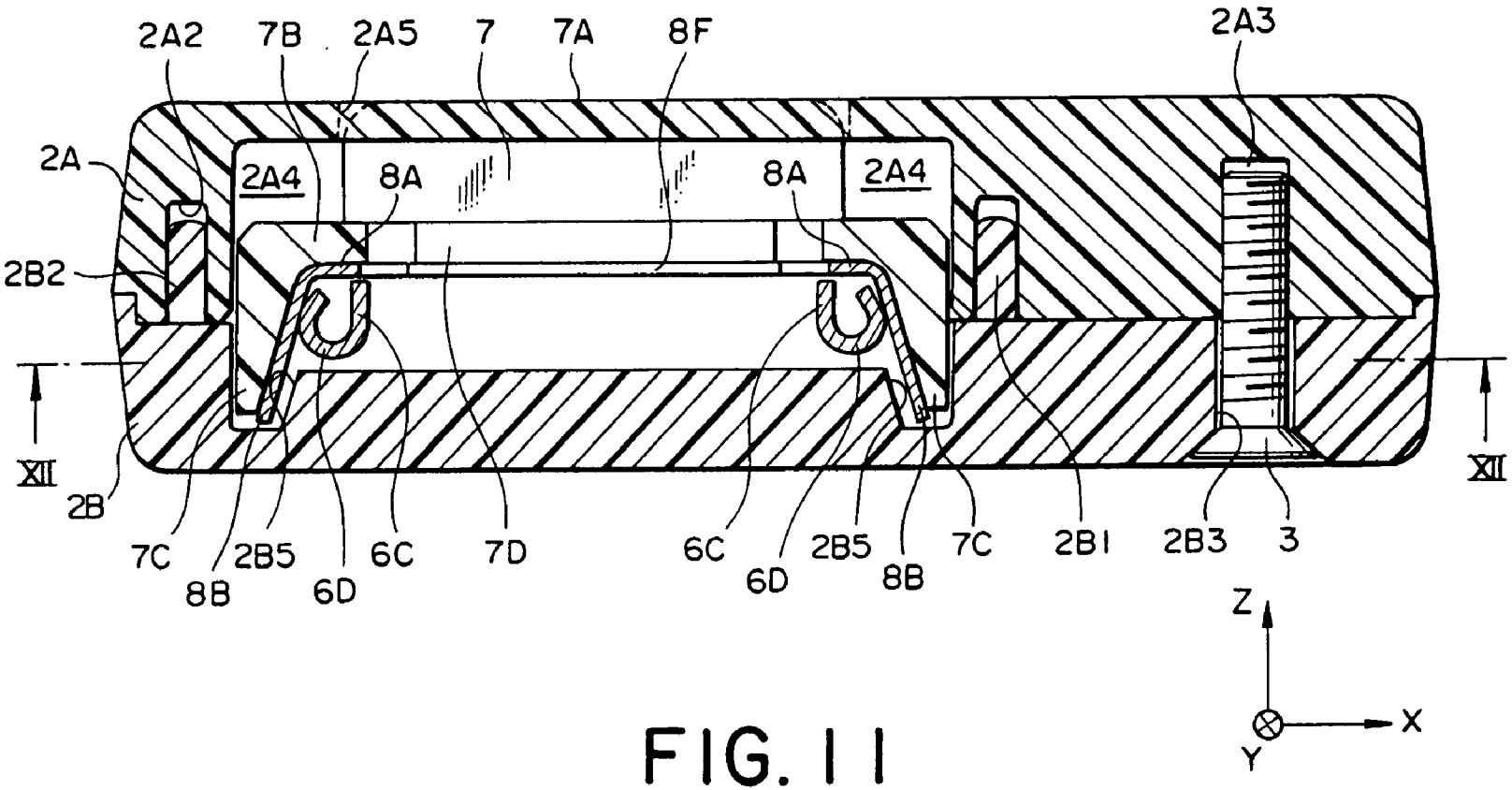
FIG. 11 is a cross-sectional view of the connector taken along lines XI—XI of FIG. 3, wherein the button is pushed down.
Figure 12:
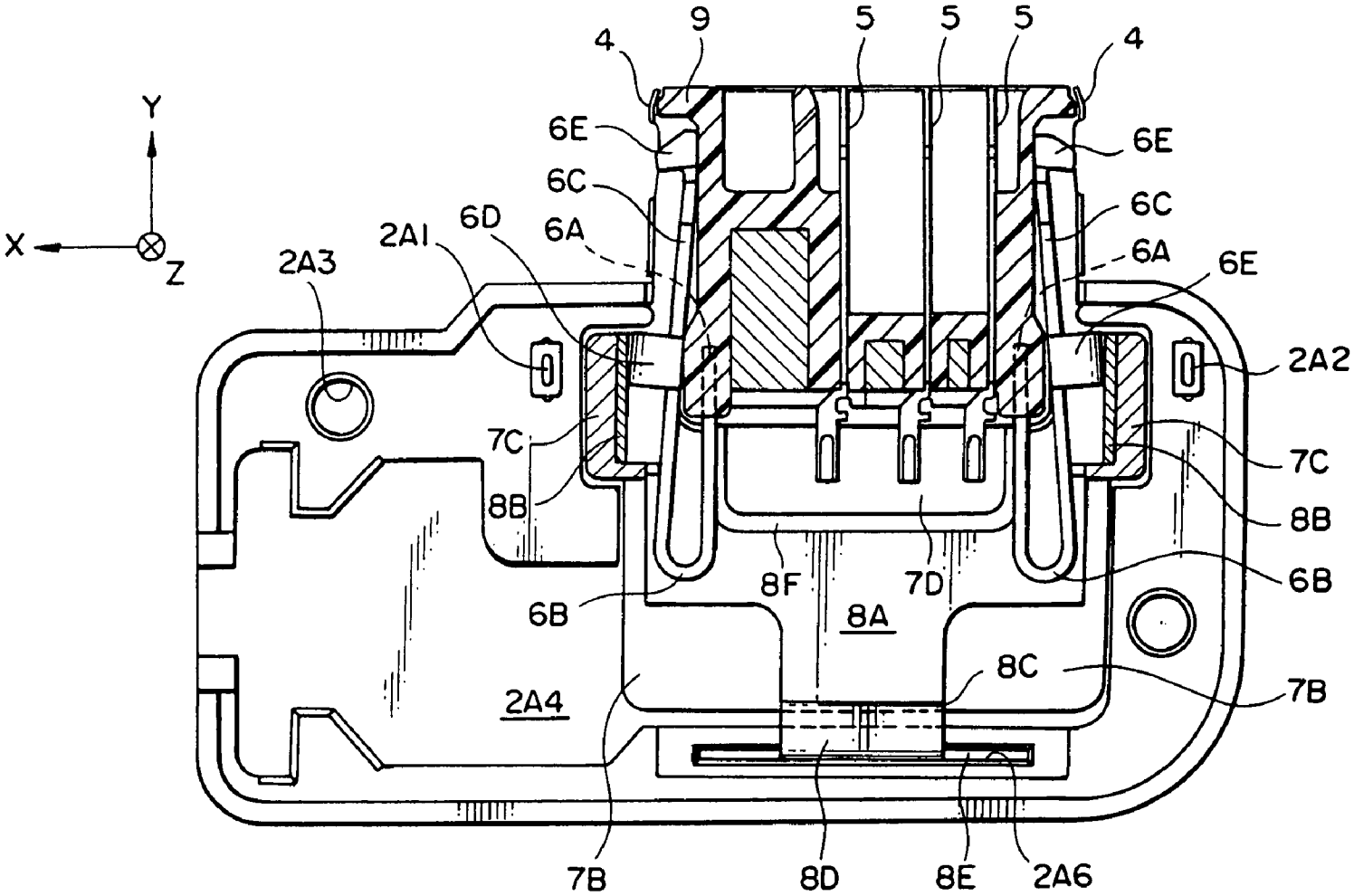
FIG. 12 is a cross-sectional view of the connector taken along lines XII—XII of FIG. 11.
Figure 13:
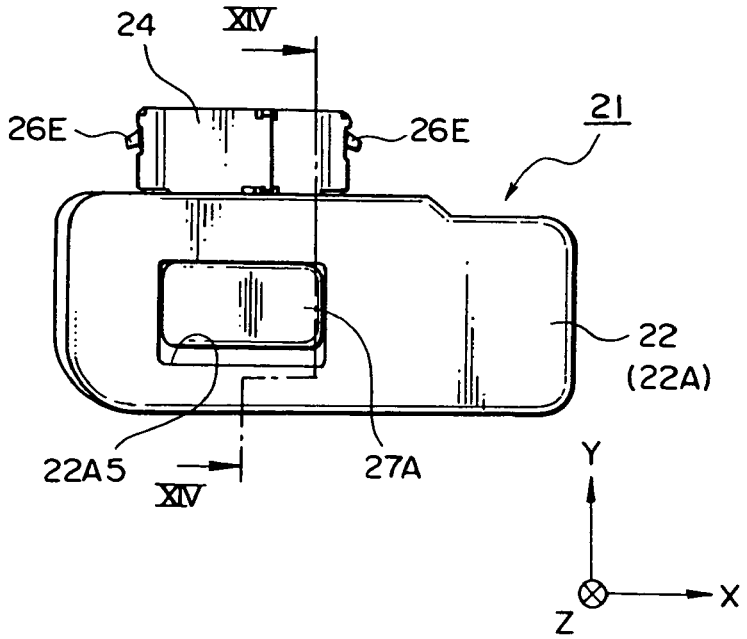
FIG. 13 is a top plan view showing a connector according to a second embodiment of the present invention.

With reference to FIGS. 11 and 12, when the button 7 is pushed down in the Z-direction, the surfaces of the slanting side portions 8B push the respective curved projections 6D simultaneously and inwardly in the X-direction, namely, toward the midpoint between the curved projections 6D. As in this embodiment, if the control mechanism meets the structural conditions that the slanting side portions 8B have structures symmetrical with each other and are also arranged symmetrically with each other with respect to the respective curved projections 6D and that the lock springs 6 have structures symmetrical with each other, the same force but toward the opposite orientations in the X-direction is added to each curved projection 6D. The forces added to the curved projections 6D elastically deform the lock springs 6 so as to simultaneously retract the respective locking claws 6E toward the inside of the shell 4, as especially shown in FIG. 12. In this state, the locking claws 6E do not work for the mating connector any longer. Therefore, the engagement of the locking claws 6E with the slits of the mating connector is released if it is established before. When being connected to the mating connector, the connector 1 can be easily fitted with the mating connector. These movements of the locking claws 6E are simultaneously achieved by the operation of the single button 7 and are easier and surer than the prior art with two buttons. In addition, the cam mechanism according to this embodiment has high endurance because it is made of metal as described above.

With reference to FIGS. 13 to 17, a connector 21 according to a second embodiment of the present invention comprises a plurality of contacts 25, an insulator 29, a shell 24 and a casing 22, similar to the first embodiment of the present invention. For example, the contacts 25 have connection portions 25A with which cables are connected. The casing 22 comprises an upper casing 22A and a lower casing 22B. An upper cavity 22A4 and a lower cavity 22B4 form one cavity for accommodating a control mechanism according to this embodiment. However, the control mechanism has a different structure from the first embodiment, as described hereinbelow.

The control mechanism according to this embodiment comprises two lock spring 26, a button 27, two cam plates 28 and a hanger-shaped spring 30. In this embodiment, the cam plates 28 serve as two cam portions which, when the button 27 is moved back in the Y-direction, add lateral forces to the lock springs 26 simultaneously to elastically deform the lock springs 26 and, thereby, to retract the locking claws 26E provided for the lock springs 26.

Figure 16:
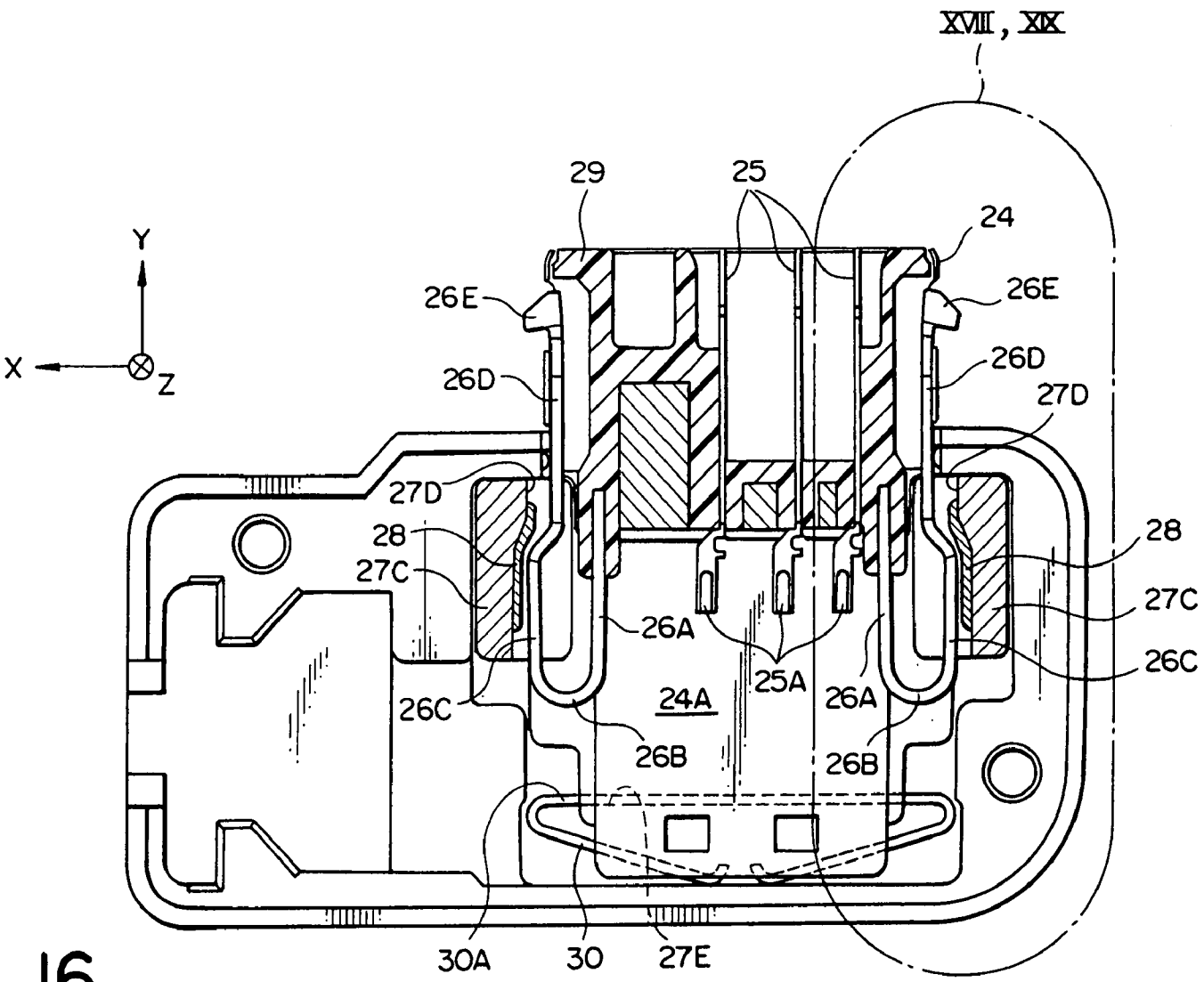
FIG. 16 is a cross-sectional view of the connector taken along lines XVI—XVI of FIG. 15.
Figure 17:
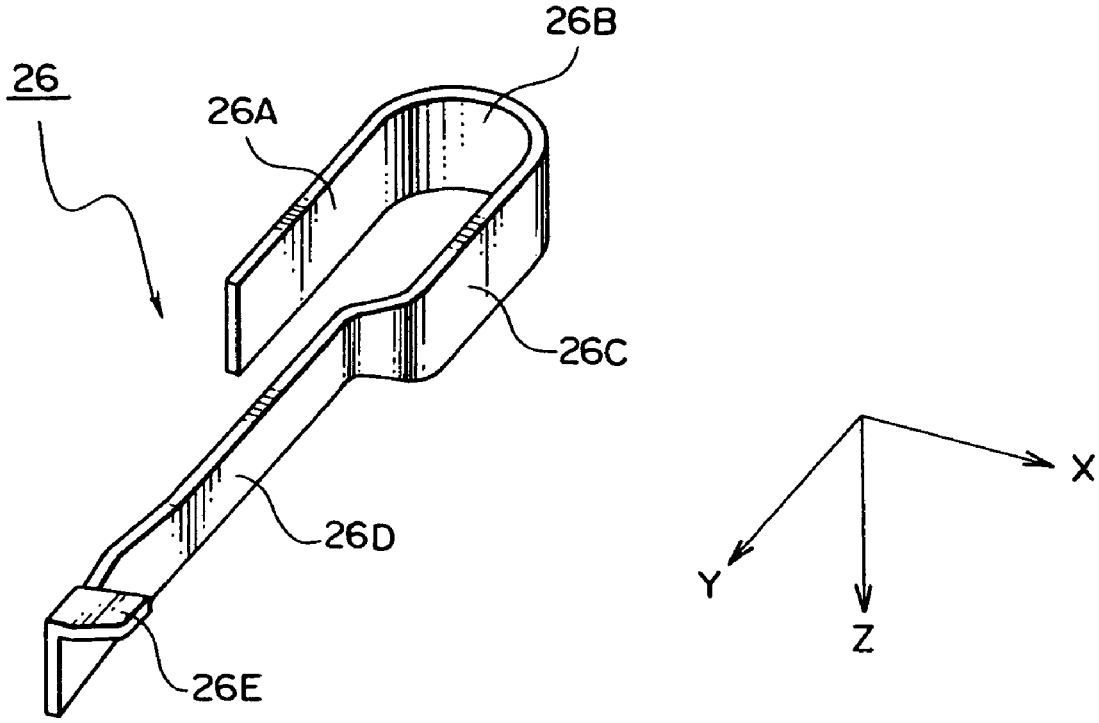
FIG. 17 is a perspective view showing a lock spring which is included in the connector of FIG. 13.

In detail, each of the lock springs 26 comprises a fixed portion 26A, a U-like portion 26B, a laterally-curved portion 26C and an extending portion 26D, in addition to the locking claw 26E, as shown in FIG. 17. The fixed portion 26A is put into and fixed into the insulator 29, as especially shown in FIG. 16. The U-like portion 26B continues from the fixed portion 26A. The laterally-curved portion 26C extends from the U-like portion 26B toward the interface defined by the shell 24 but is curved outwardly in the X-direction, as shown in FIG. 16. In other words, the laterally-curved portion 26C projects outwardly in the X-direction. The extending portion 26D continues from the laterally-curved portion 26C and extends in the Y-direction. The extending portion 26D is parallel to a part of the laterally-curved portion 26C in this embodiment. On the tip of the extending portion 26D, the locking claw 26E is formed so as to project outwardly in the X-direction.

Figure 14:
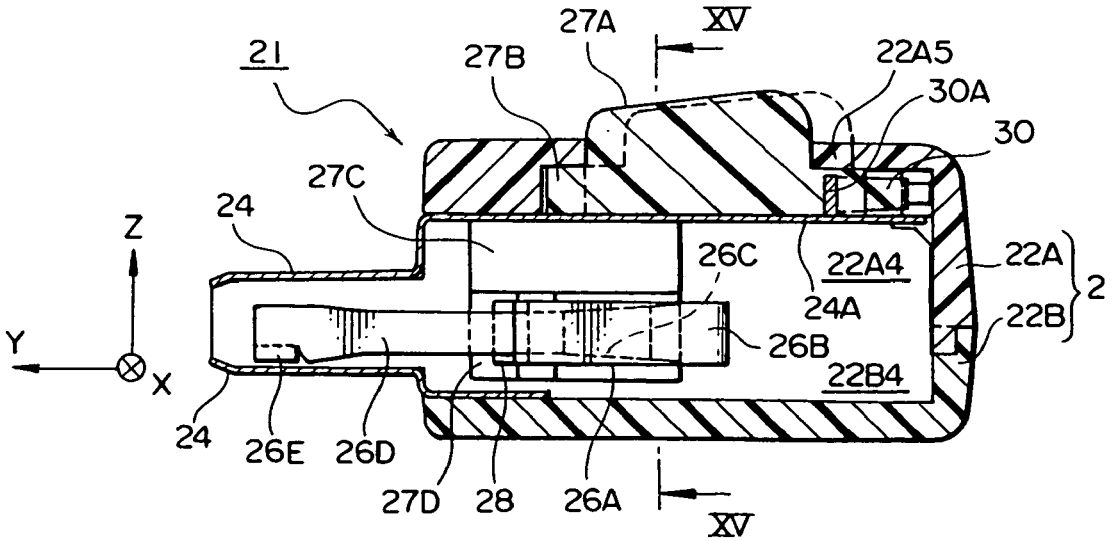
FIG. 14 is a cross-sectional view of the connector taken along lines XIV—XIV of FIG. 13, wherein some parts are omitted for the sake of better understanding.
Figure 15:
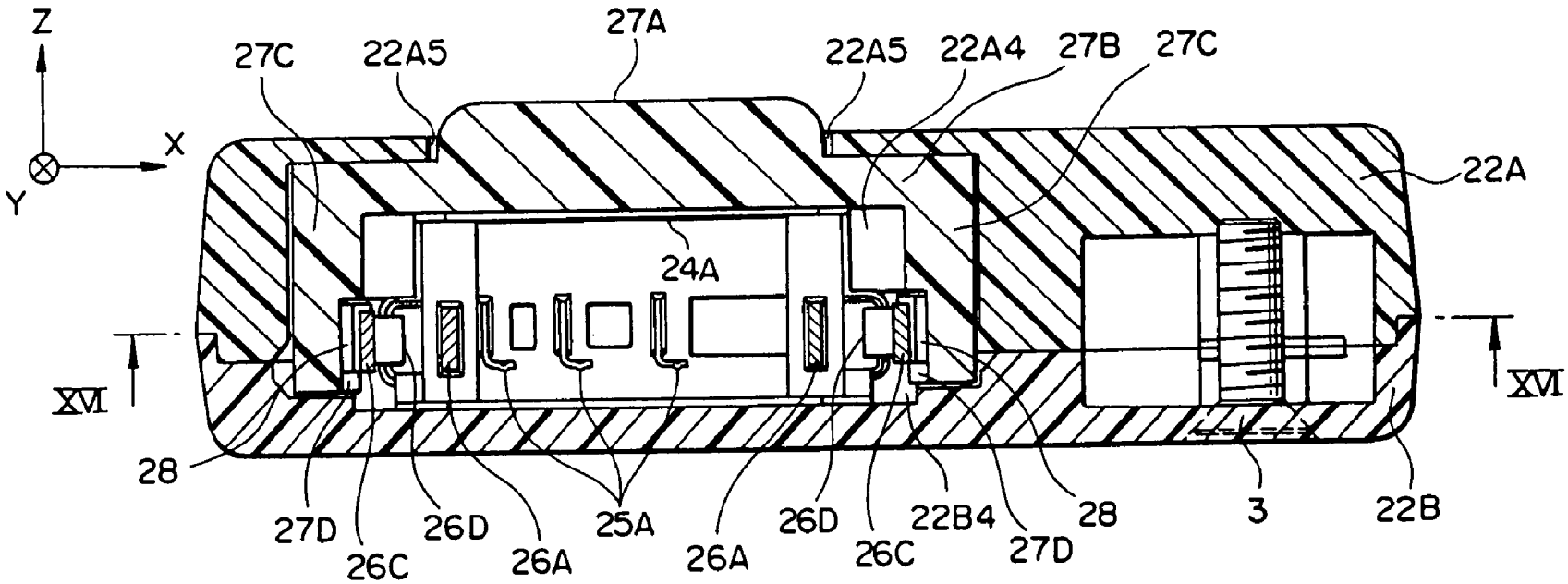
FIG. 15 is a cross-sectional view of the connector taken along lines XV—XV of FIG. 14.

The button 27 comprises a main part having an upper surface 27A which projects through an opening 22A5 of the upper casing 22A to the outside of the connector 21, as shown for example in FIGS. 14 and 15. The main part of the button 27 is formed on a base portion 27B which is an insulator plate having a rectangular shape. On the ends of the base portion 27B in the Y-direction and at the opposite sides of the base portion 27B in the X-direction, two arm portions 27C are provided. The arm portions 27C extend downwardly in the Z-direction. Each of the arm portions 27C is provided with a palm portion 27D, which has a particular surface consisting of three parts. Two parts among the three parts of the particular surface are parallel to a Y-Z plane. That is, the two parts are parallel to each other but are not on the same plane. The other part of the particular surface connects the foregoing two parts so as to be diagonally across a Y-Z plane.

The button 27 is also provided with a groove 27E for holding a fixed portion 30A of the hanger-shaped spring 30, as shown in FIGS. 14 and 16. The groove 27 and the fixed portion 30A extend in the X-direction. The fixed portion 30A fitted within the groove 27 is supported by the upper surface 24A of the shell 24 so as to be fixed in the button 27. The hanger-shaped spring 30 adds to the button 27 an elastic force in accordance with which the button 27 is in the normal position thereof when the button 27 is not operated. In this embodiment, the spring 30 is formed by bending a narrow plate so as to be shaped like a cloth-hanger.

The cam plates 28 are made of metal and have similar shapes to the respective palm portions 27D of the button 27. Specifically, the cam plates 28 have surfaces each shaped like a gentle staircase of a single step. The cam plates 28 are attached on the palm portions 27D so as to face the respective curved portions 26C. Each of the cam plates 28 has three portions, two of which extend in the Y-direction and the other connects them so as to be diagonally across the Y-direction and the X-direction. The diagonal portion of the cam plate 28 essentially provides a cam function when moving in the Y-direction.

Figure 18:
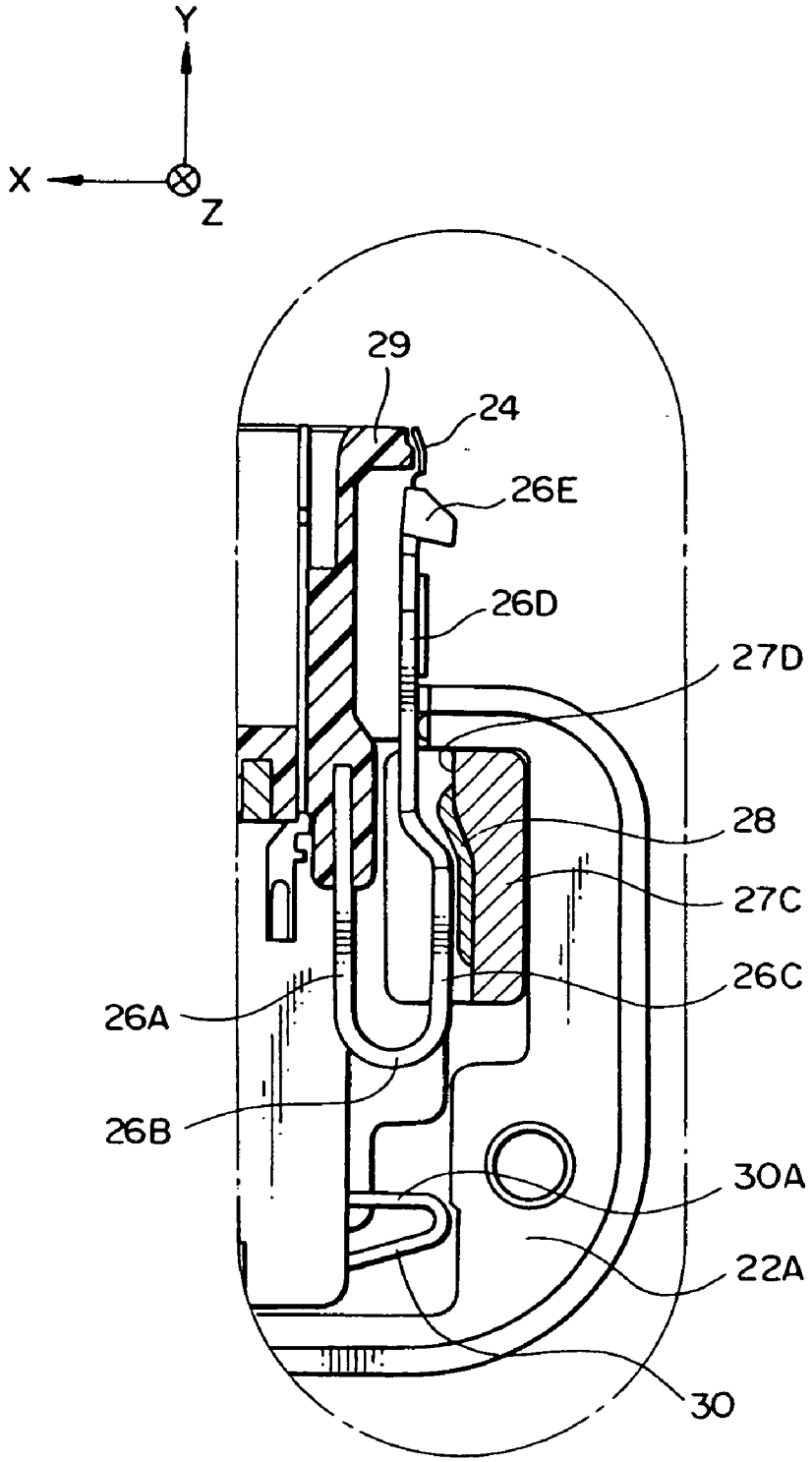
FIG. 18 is a partial, enlarged, cross-sectional view of the connector shown in FIG. 16, wherein the button is still not slid.
Figure 19:
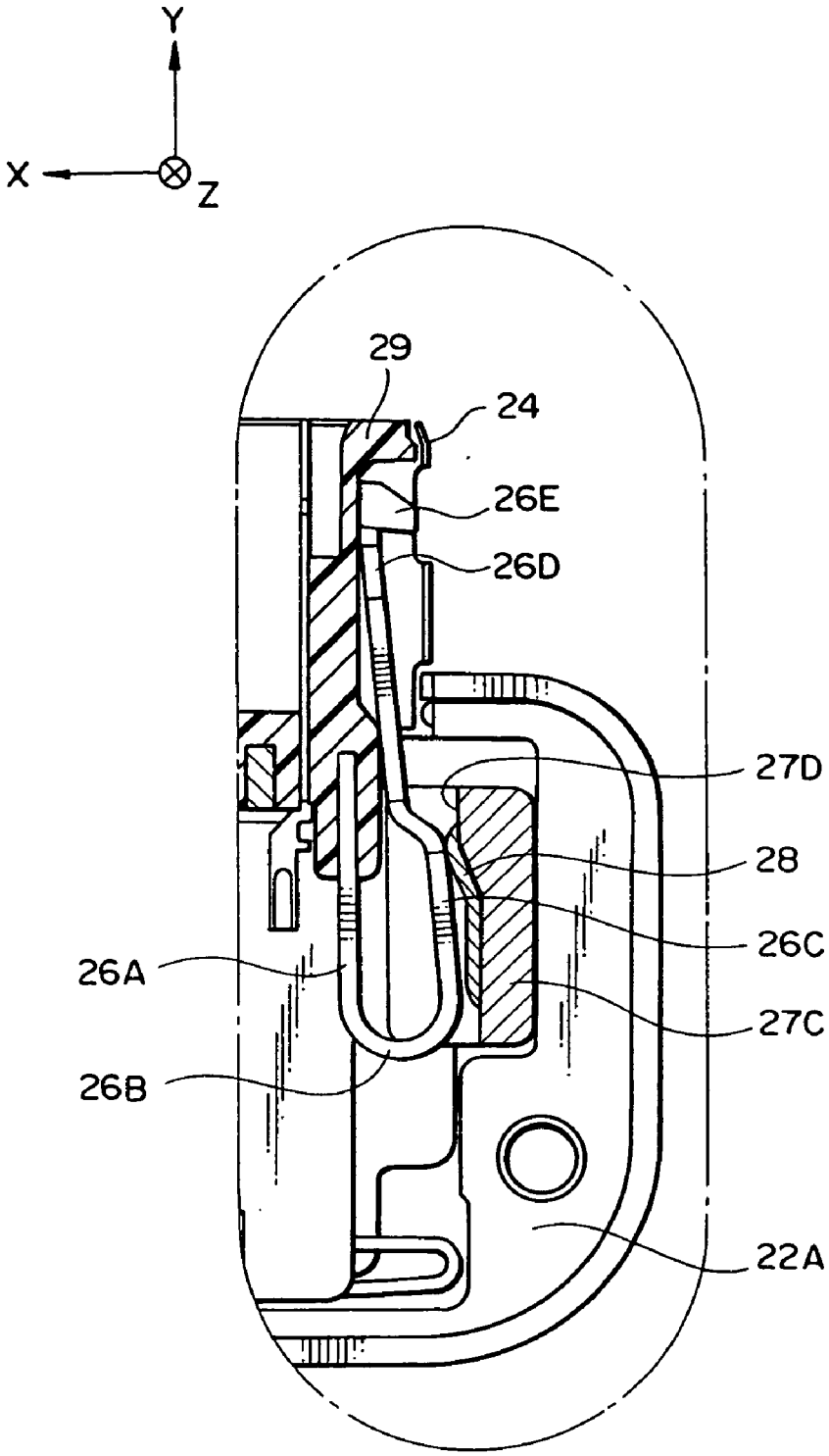
FIG. 19 is a partial, enlarged, cross-sectional view of the connector shown in FIG. 16, wherein the button is slid backwardly.
Figure 20:
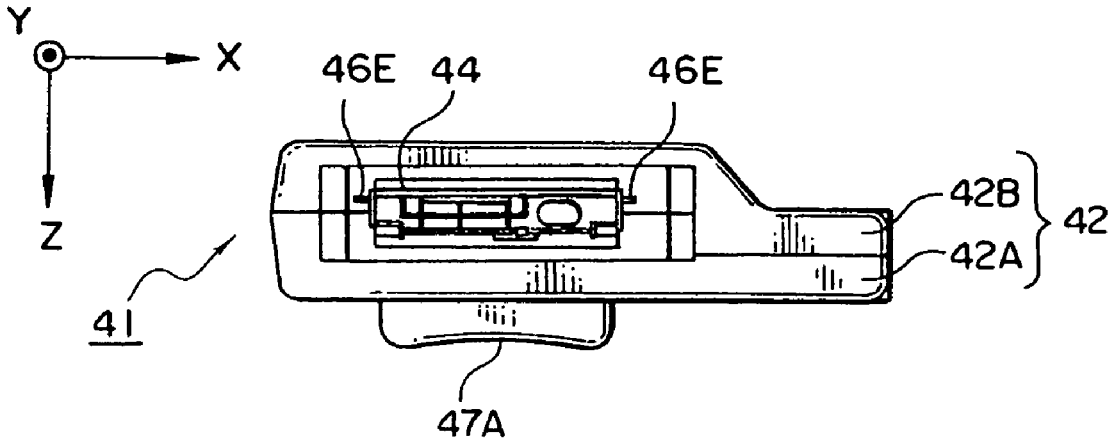
FIG. 20 is a front view showing a connector according to a third embodiment of the present invention.
Figure 21:
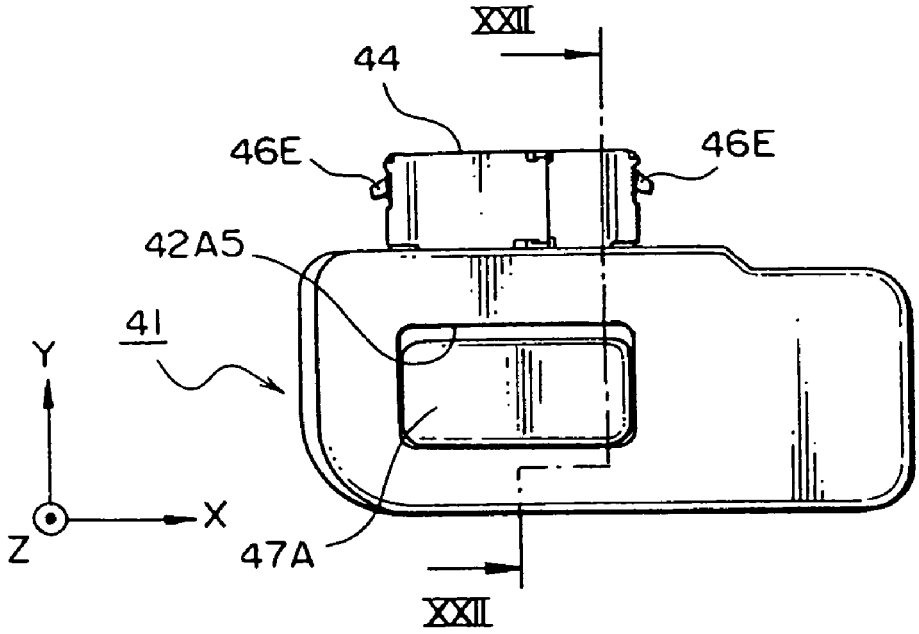
FIG. 21 is a top plan view of the connector illustrated in FIG. 20.
Figure 22:
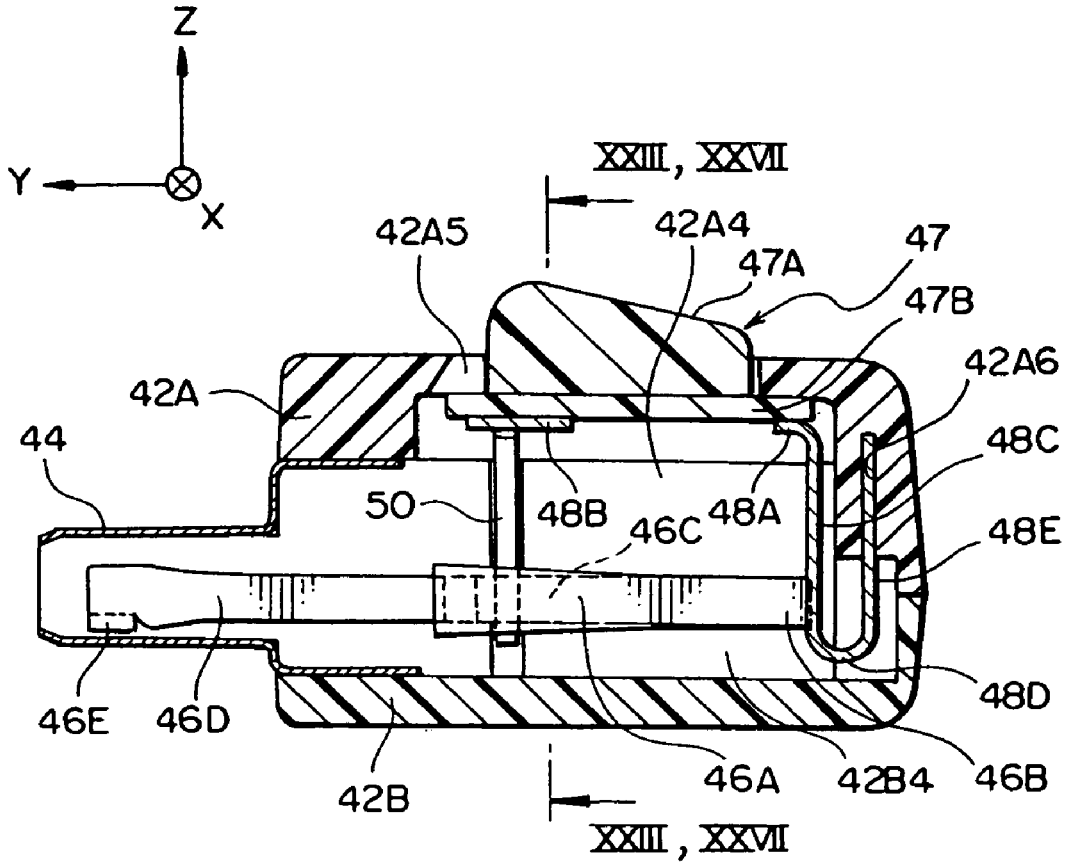
FIG. 22 is a cross-sectional view of the connector taken along lines XXII—XXII of FIG. 21, wherein some parts are omitted for the sake of better understanding.
Figure 23:
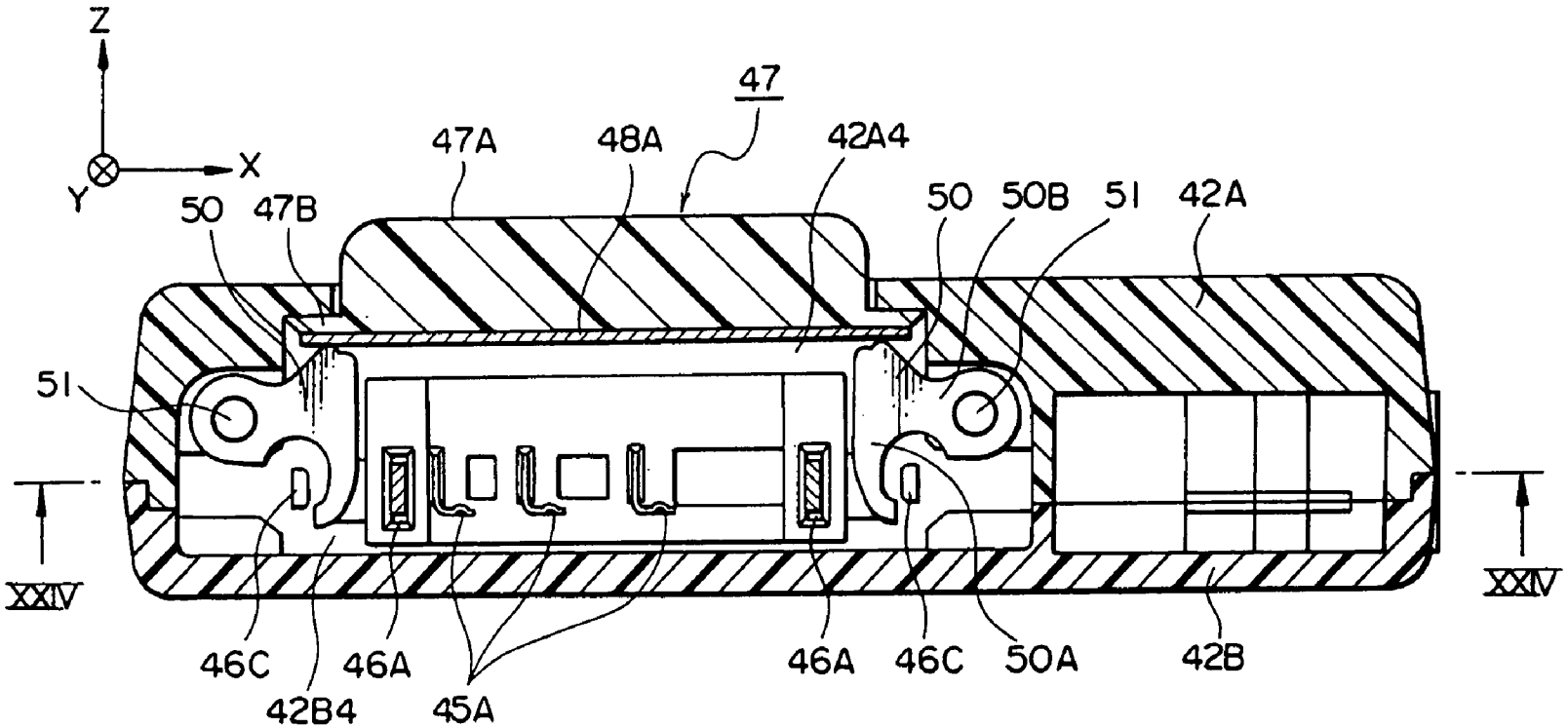
FIG. 23 is a cross-sectional view of the connector taken along lines XXIII—XXIII of FIG. 22.

As seen from FIGS. 18 and 19, when the button 27 is moved back in the Y-direction, the diagonal portions of the cam plates 28 push the respective laterally-curved portions 26C simultaneously and inwardly in the X-direction, namely, toward the midpoint between the portions 26C. As in this embodiment, if the control mechanism meets the structural conditions that the cam plates 28 have structures symmetrical with each other and are also arranged symmetrically with each other with respect to the respective laterally-curved projections 26C and that the lock springs 26 have structures symmetrical with each other, the same force but toward the opposite orientations in the X-direction is added to each laterally-curved portion 26C. The forces added to the laterally-curved projections 26C elastically deform the lock springs 26 so as to simultaneously retract the respective locking claws 26E toward the inside of the shell 24, as especially shown in FIG. 19. These movements of the locking claws 26E are simultaneously achieved by the operation of the single button 27 and are easier and surer than the prior art with two buttons. In addition, the cam mechanism according to this embodiment has high endurance because it is made of metal as described above.

With reference to FIGS. 20 to 26, a connector 41 according to a third embodiment of the present invention comprises a plurality of contacts 45, an insulator 49, a shell 44 and a casing 42, similar to the first embodiment of the present invention. For example, the contacts 45 have connection portions 45A with which cables are connected. The casing 42 comprises an upper casing 42A and a lower casing 42B. An upper cavity 42A4 and a lower cavity 42B4 form one cavity for accommodating a control mechanism according to this embodiment. However, the control mechanism also including a part of the upper casing 42A has a different structure from the first embodiment, as described hereinbelow.

The upper casing 42A of this embodiment comprises an opening 42A5, a slit 42A6, two pin pockets 22A7 and two fulcrum projections 42A8. The opening 42A5 is formed on the upper surface of the upper casing 42A so as to communicate between the upper cavity 42A4 and the outside of the casing 42. The slit 42A6 is formed so as to extend in the X-direction. Each of the pin pockets 22A7 is formed with a plurality of small projections. Two fulcrum projections 42A8 are formed on an edge of the upper casing 42A in the Y-direction and project inwardly in the X-direction, namely, toward the midpoint between the fulcrum projections 42A8, so as to face each other. In this embodiment, the fulcrum projections 42A8 serve as parts of the control mechanism of this embodiment. The other roles of these parts mentioned above are described below.

The control mechanism according to this embodiment further comprises two lock spring 46, a button 47, a button-support spring 48, two falcate plates 50 and two pins 51. In this embodiment, the falcate plates 50 rotating essentially serve as two cam portions which, when the button 47 is pushed down in the Z-direction, add lateral forces to the lock springs 46 simultaneously to elastically deform the lock springs 46 in cooperation with the fulcrum projections 42A8 and, thereby, to retract the locking claws 46E provided for the lock springs 46.

Figure 24:
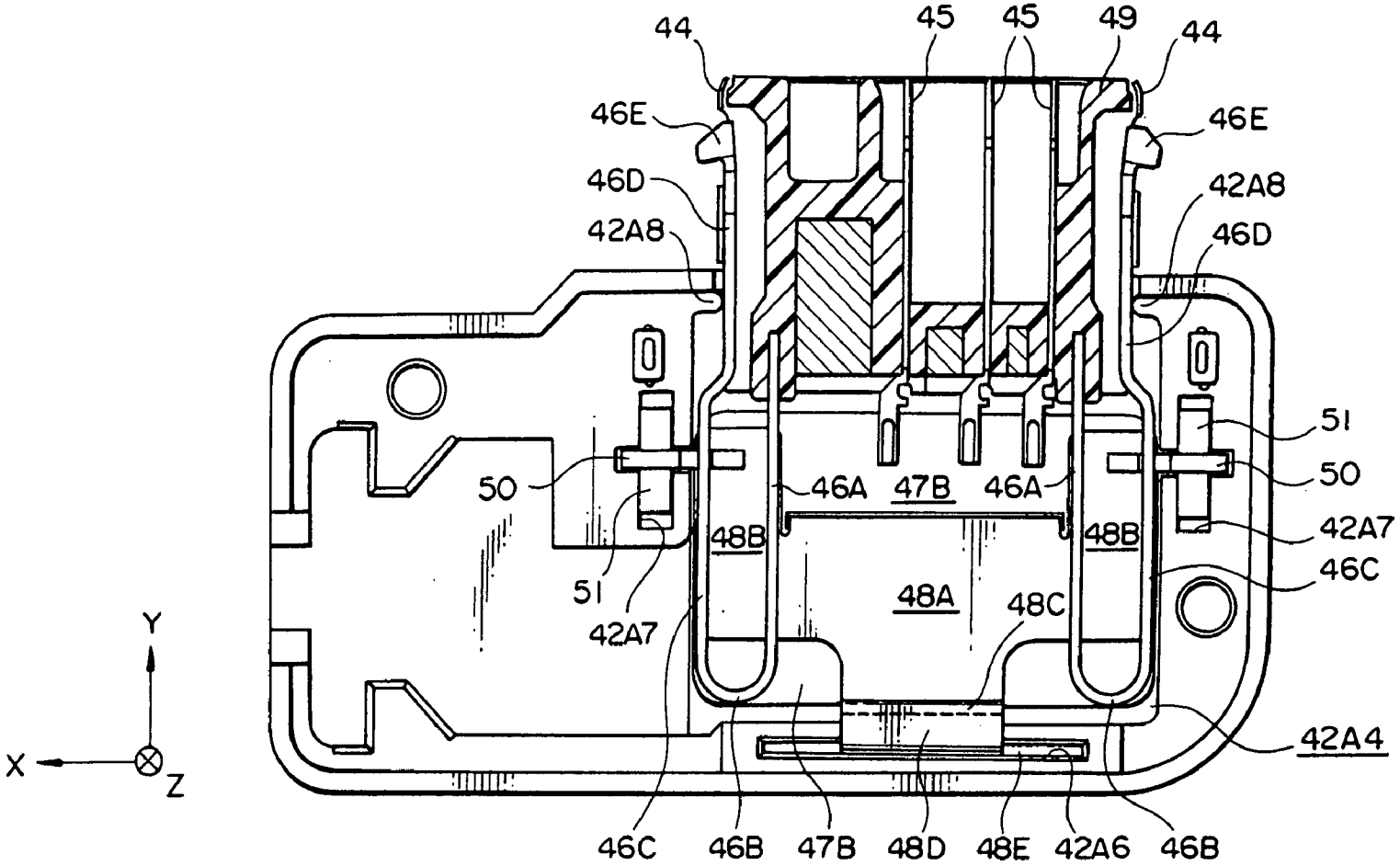
FIG. 24 is a cross-sectional view of the connector taken along lines XXIV—XXIV of FIG. 23.
Figure 25:
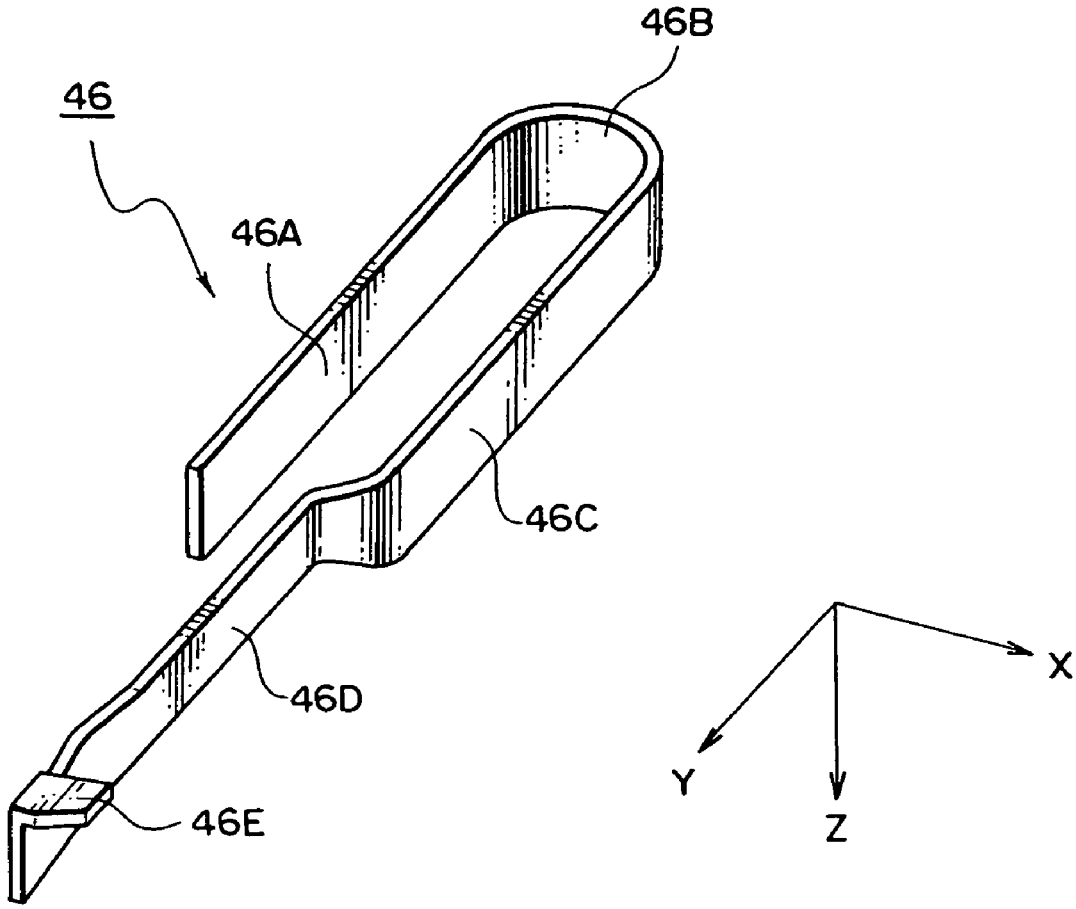
FIG. 25 is a perspective view showing a lock spring which is included in the connector of FIG. 20.

In detail, each of the lock springs 46 comprises a fixed portion 46A, a U-like portion 46B, a laterally-curved portion 46C and an extending portion 46D, in addition to the locking claw 46E, as shown in FIG. 25. The fixed portion 46A is put into and fixed into the insulator 49, as especially shown in FIG. 24. The U-like portion 46B continues from the fixed portion 46A. The laterally-curved portion 46C extends from the U-like portion 46B toward the interface defined by the shell 44 but is curved outwardly in the X-direction, as shown in FIG. 24. In other words, the laterally-curved portion 46C projects outwardly in the X-direction. The extending portion 46D continues from the laterally-curved portion 46C and extends in the Y-direction. At the outside of the extending portion 46D, the fulcrum projection 42A8 is positioned, as shown in FIG. 24. The positions of the fulcrum projections 42A8 are nearer the locking claws 46E than those of the falcate plates 50 in the Y-direction. The extending portion 46D is parallel to a part of the laterally-curved portion 46C in this embodiment. On the tip of the extending portion 46D, the locking claw 46E is formed so as to project outwardly in the X-direction.

In this embodiment, the lock springs 46 have shape symmetrical with each other. In addition, the fulcrum projections 42A8 have shape symmetrical with each other and are arranged symmetrically with each other with respect to the respective laterally-curved portions 46D.

The button 47 comprises a main part having an upper surface 47A which projects through the opening 42A5 of the upper casing 42 to the outside of the connector 41, as shown for example in FIGS. 20 to 23. The main part of the button 47 is formed on a base portion 47B which is an insulator plate.

Figure 26:
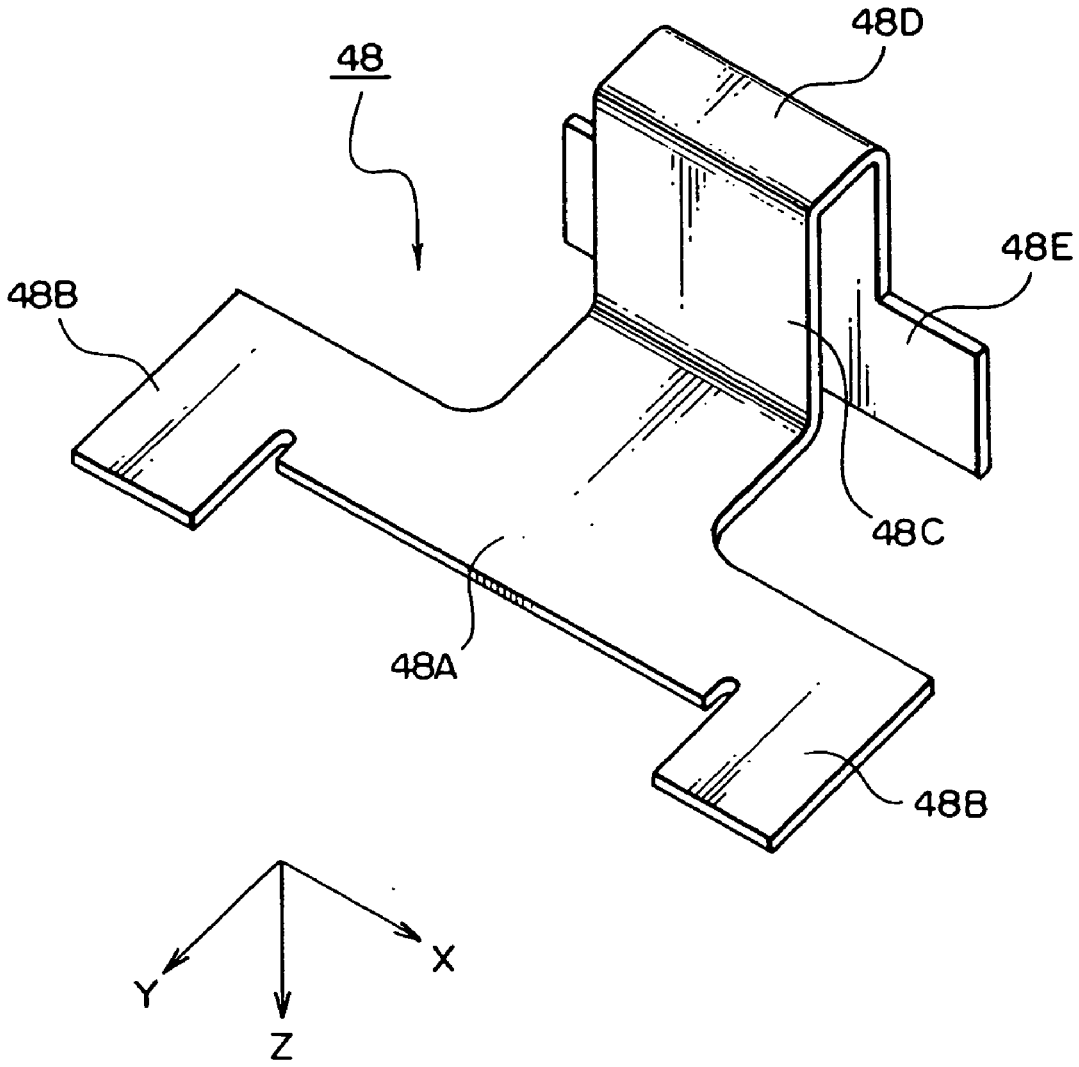
FIG. 26 is a perspective view showing a button-support spring which is included in the connector of FIG. 20.

The button 47 is elastically supported by the button-support spring 48. The button-support spring 48 comprises a main plate 48A, two pushing portions 48B, a vertical portion 48C, a U-like portion 48D and a fixed portion 48E, as shown in FIG. 26. The main plate 48A actually supports the button 47, especially, the base portion 47B of the button 47. The main plate 48A has a T-like shape. From the opposite sides of the main plate 48A, the pushing portions 48B extend in the Y-direction, specifically, toward the interface defined by the shell 44. The pushing portions 48B are portions which add forces to the falcate plates 50 when the button 47 is pushed down. If the button 47 has enough strength, the pushing portions 48B can be omitted.

The vertical portion 48C of the button-support spring 48 extends from the rear end of the main plate 48A downwardly in the Z-direction and continues to the U-like portion 48D. The fixed portion 48E continues and extends upwardly from the U-like portion 48D. The end of the fixed portion 48E is inserted into and fitted within the slit 42A6 of the upper casing 42A. The vertical portion 48C, the U-like portion 48D and the fixed portion 48E provide an elastic force for the support of the button 47. This elastic support results in that the button 47 is in the normal position thereof when the button 47 is not operated.

Each of the falcate plates 50 comprises an edge portion 50A and a grip portion. The grip portion 50B is provided with a hole into which the pin 51 is inserted. By this insertion, the grip portion 50B is supported by the pin 51 so as to turn around the pin 51 with the edge portion 50A being apart from the pin 51. The pins 51 are surely fitted within the pin pockets 42A7 of the upper casing 42A when the pins 51 are pushed and inserted within the pin pockets 42A7 because of the small projections provided for the pin pockets 42A7. Thus, only the falcate plates 50 can turn but the pins 51 cannot rotate in this embodiment.

The edge portions 50A of the falcate plates 50 are positioned partially inside the respective laterally-curved portions 46C of the lock springs 46 in the X-direction. In detail, the edge portions 50A are in contact with or are arranged close to the laterally-curved portions 46C when the button 47 is not operated. Each of the edge portions 50A has a curved edge facing the laterally-curved portion 46C. If the falcate plate 50 turns, the curved edge of the edge portion 50A can provide a cam function on the laterally-curved portion 46C.

In this embodiment, the falcate plates 50 have structures symmetrical with each other and are also symmetrically with each other with respect to the respective laterally-curved portions 46C.

Figure 27:
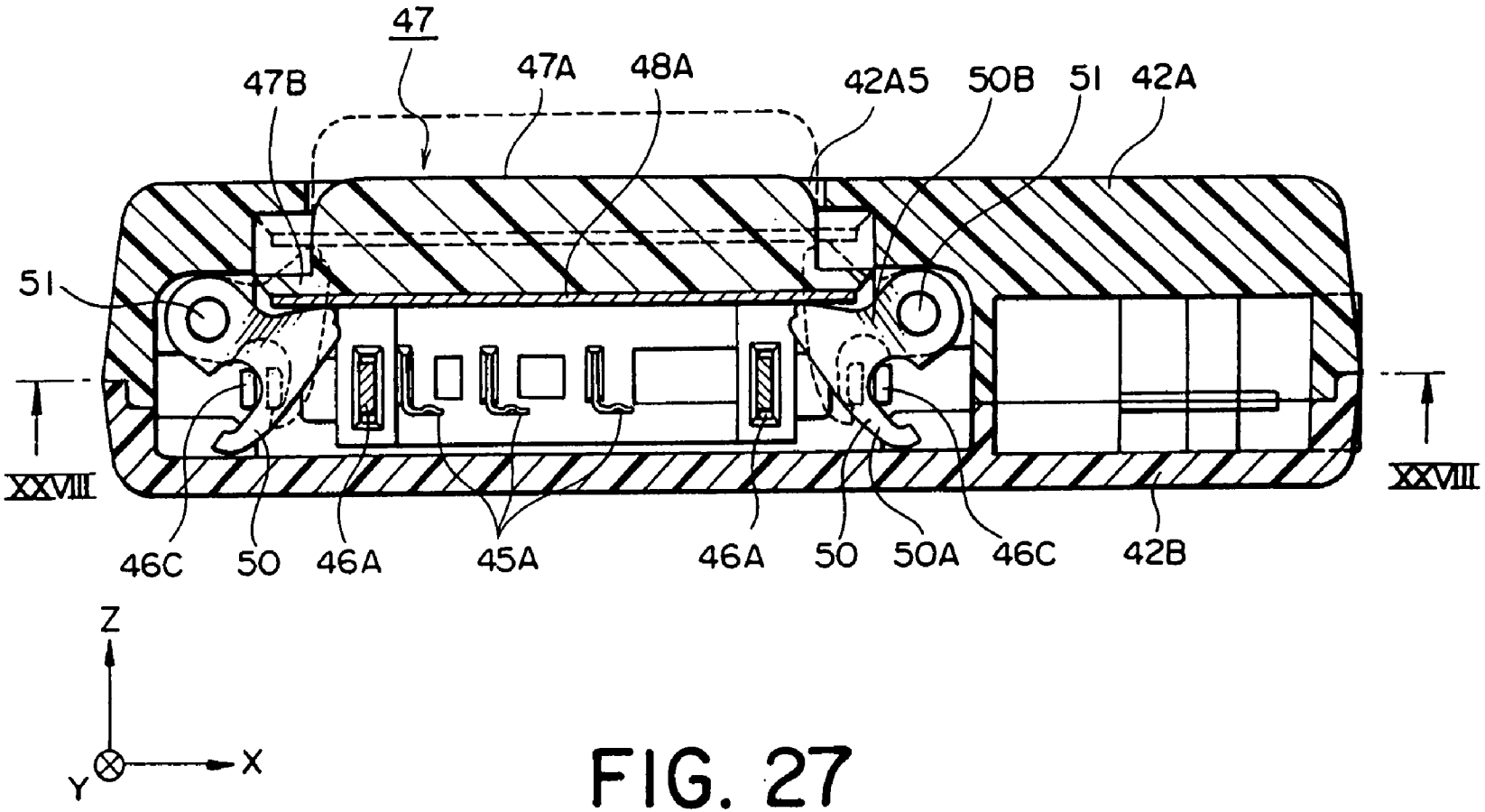
FIG. 27 is a cross-sectional view of the connector taken along lines XXVII—XXVII of FIG. 22, wherein the button is pushed down.
Figure 28:
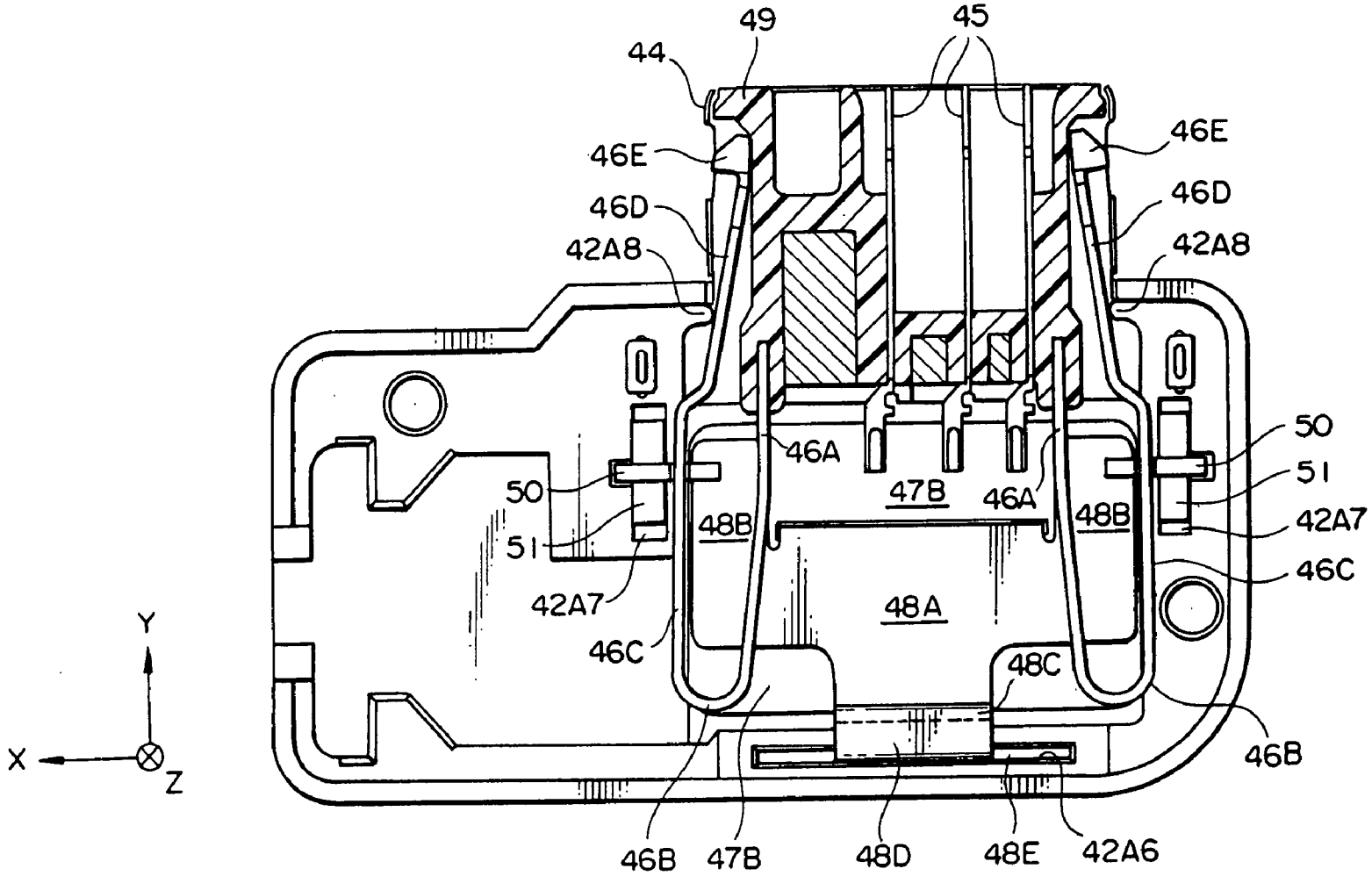
FIG. 28 is a cross-sectional view of the connector taken along lines XXVIII—XXVIII of FIG. 27.

With reference to FIGS. 27 and 28, when the button 47 is pushed down in the Z-direction, the pushing portions 48B of the button-support spring 48 simultaneously push the respective falcate plates 50 so that the falcate plates 50 turn around the respective pins 51. As the falcate plates 50 turn, the edge portions 50A pull the respective laterally-curved portions 46C outwardly in the X-direction. At that time, the fulcrum projections 42A8 of the upper casing 42 are in contact with the respective extending portions 46D and function as fulcrums in leverage. Because the fulcrum projections 42A8, the lock springs 46, and the falcate plates 50 meet the symmetrical requirements as mentioned in the first and second embodiments, the leverage forces are the same force but toward the opposite orientations in the X-direction. The forces added to the laterally-curved portions 46C elastically deform the lock springs 46 under the aforementioned leverage so as to simultaneously retract the respective locking claws 46E toward the inside of the shell 4, as especially shown in FIG. 28. These movements of the locking claws 46E are simultaneously achieved by the operation of the single button 47 and are easier and surer than the prior art with two buttons.

What is claimed is:

1. A connector comprising at least two springs provided with locking projections, respectively, and a control mechanism which controls positions of the locking projections, the control mechanism comprising a single button and a cam mechanism, which is coupled to the single button and has two cam portions arranged close to the two springs, comprising in a first direction an opening through which the single button partially projects outside the connector, wherein: the two springs are arranged parallel to each other in a second direction perpendicular to the first direction; wherein: the two springs are provided with curved portions, which are curved and project outwardly in the second direction; the cam mechanism comprises two cam plates as the cam portions, which are fitted with the single button so as to face the curved portions, respectively; each of the cam plates has a surface shaped like a gentle staircase of a single step; and the surfaces of the cam plates push the curved portions inwardly in the second direction when the single button is moved back in a third direction perpendicular to the first and the second directions, so that, when the single button is operated, the two cam portions add forces corresponding to movement of the single button to the two springs simultaneously to elastically deform the two springs and thereby to control the positions of the locking projections; the locking projections are arranged parallel to each other in the second direction; and the cam mechanism is coupled to the single button within the connector so that the two cam portions are arranged close to the two springs in the second direction.

2. A connector comprising at least two springs provided with locking projections, respectively, and a control mechanism which controls positions of the locking projections, the control mechanism comprising a single button and a cam mechanism, which is coupled to the single button and has two cam portions arranged close to the two springs, comprising in a first direction an opening through which the single button partially projects outside the connector, wherein: the two springs are arranged parallel to each other in a second direction perpendicular to the first direction; wherein: each of the two springs is provided with first and second portions; the first portion extends in a third direction perpendicular to the first and the second directions and is provided with the locking projection; the second portion is connected to the first portion in the third direction; the cam mechanism comprises as the cam portions two falcate plates, two pins and fulcrum portions; the falcate plates have edge portions and grip portions; the pins support the grip portions of the falcate plates to allow the grip portions to turn around the pins with the edge portions being apart from the pins; the edge portions are positioned partially insides the second portions in the second direction; the fulcrum portions position nearer the locking projections than the falcate plates in the third direction; so that, when the single button is operated, the two cam portions add forces corresponding to movement of the single button to the two springs simultaneously to elastically deform the two springs and thereby to control the positions of the locking projections; the locking projections are arranged parallel to each other in the second direction; and the cam mechanism is coupled to the single button within the connector so that the two cam portions are arranged close to the two springs in the second direction and so that the grip portions of the falcate plates turn around the pins when the single button is pushed down in the first direction; and, when the grip portions of the falcate plates turn around the pins, the edge portions pull the second portions outwardly in the second direction, while the fulcrum portions are in contact with the first portions, so that the locking projections are retracted within the connector in accordance with leverage by the falcate plates turning and the fulcrum portions.

3. The connector according to claim 2, wherein the second portions of the two springs are curved portions, which are curved and project outwardly in the second direction.

4. The connector according to claim 1, comprising another spring, which forces the single button to be in a normal position when the single button is not operated.

5. The connector according to claim 2, comprising another spring, which forces the single button to be in a normal position when the single button is not operated.

* * * * *